US011911669B2

(12) United States Patent
Brubaker et al.

(10) Patent No.: US 11,911,669 B2
(45) Date of Patent: Feb. 27, 2024

(54) GOLF CLUB HEAD WITH MULTI-MATERIAL CONSTRUCTION

(71) Applicant: Karsten Manufacturing Corporation, Phoenix, AZ (US)

(72) Inventors: Cole D. Brubaker, Scottsdale, AZ (US); Clayson C. Spackman, Scottsdale, AZ (US); Joshua B. Matthews, Phoenix, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/855,703

(22) Filed: Jun. 30, 2022

(65) Prior Publication Data

US 2023/0013914 A1 Jan. 19, 2023

Related U.S. Application Data

(60) Provisional application No. 63/218,214, filed on Jul. 2, 2021.

(51) Int. Cl.
*A63B 53/04* (2015.01)

(52) U.S. Cl.
CPC ..... *A63B 53/04* (2013.01); *A63B 53/045* (2020.08); *A63B 53/047* (2013.01); *A63B 53/0416* (2020.08); *A63B 53/0437* (2020.08); *A63B 53/0466* (2013.01); *A63B 53/0487* (2013.01); *A63B 2053/0491* (2013.01); *A63B 2209/02* (2013.01)

(58) Field of Classification Search
CPC ..... A63B 53/0425; A63B 53/0429
USPC ..... 473/324–350
See application file for complete search history.

(56) References Cited

U.S. PATENT DOCUMENTS

| | | | | |
|---|---|---|---|---|
| 1,094,599 A | | 4/1914 | Samson | |
| 4,630,826 A | | 12/1986 | Nishigaki | |
| 4,681,322 A | * | 7/1987 | Straza | A63B 53/04 473/329 |
| 5,328,176 A | | 7/1994 | Lo | |
| 5,377,986 A | | 1/1995 | Viollaz | |

(Continued)

FOREIGN PATENT DOCUMENTS

| | | | | |
|---|---|---|---|---|
| CN | 103386184 A | * | 11/2013 | A63B 53/04 |
| JP | H0576628 | | 3/1993 | |

(Continued)

OTHER PUBLICATIONS

International Search Report / Written Opinion from PCT Application No. PCT/US2022/035872, dated Oct. 5, 2022.

*Primary Examiner* — Alvin A Hunter

(57) ABSTRACT

Embodiments of golf club heads with components composed of a metal-composite-metal construction are described herein. The metal-composite-metal construction makes up a portion of the golf club head. The metal-composite-metal construction can make up any one or combination of the following structures: faceplate, face insert, internal ribs, turbulators, crown insert, or weight channel. The composite layer of the metal-composite-metal construction is composed of reinforced fibers. The metal-composite-metal construction allows for weight savings in the golf club head while maintaining durability, strength, rigidity, and performance.

40 Claims, 19 Drawing Sheets

(56) References Cited

U.S. PATENT DOCUMENTS 5,380,010 A 1/1995 Werner
5,425,538 A 6/1995 Vincent
5,445,382 A 8/1995 Pearce
5,467,983 A * 11/1995 Chen ..... A63B 53/0466 473/346
5,669,827 A * 9/1997 Nagamoto ..... A63B 60/00 473/345
5,766,094 A * 6/1998 Mahaffey ..... A63B 60/00 473/347
5,967,903 A * 10/1999 Cheng ..... A63B 53/047 473/349
6,354,963 B1 3/2002 Kodama
6,402,637 B1 6/2002 Sasamoto
6,932,716 B2 8/2005 Ehlers
7,361,099 B2 * 4/2008 Rice ..... A63B 60/42 473/345
7,380,325 B2 * 6/2008 Takeda ..... A63B 53/047 473/324
7,651,412 B2 1/2010 Meyer
7,874,937 B2 1/2011 Chao
8,007,369 B2 * 8/2011 Soracco ..... A63B 53/04 473/332
8,303,435 B2 11/2012 Chao
8,409,032 B2 * 4/2013 Myrhum ..... A63B 53/0466 473/345
8,444,504 B2 5/2013 Chao
8,449,406 B1 * 5/2013 Frame ..... A63B 53/047 473/332
8,480,512 B2 7/2013 Oldknow
8,617,001 B2 12/2013 Sandoval
8,628,434 B2 1/2014 Chao
8,882,609 B2 * 11/2014 Boyd ..... A63B 53/0475 473/345
8,926,450 B2 1/2015 Takahashi
8,926,451 B2 * 1/2015 Deshmukh ..... B21K 17/00 473/349
8,956,247 B2 * 2/2015 Morin ..... A63B 53/0466 473/345
9,056,230 B2 6/2015 Golden
9,283,449 B1 3/2016 Demille
9,579,548 B2 2/2017 Boyd
9,717,960 B2 8/2017 Deshmukh
9,821,203 B2 11/2017 Dolezel
10,207,162 B2 * 2/2019 Deshmukh ..... A63B 53/0475
10,398,951 B2 * 9/2019 Golden ..... B21K 17/00
10,814,192 B2 10/2020 Sander
10,828,543 B2 11/2020 Morales
11,065,513 B2 * 7/2021 Tassistro ..... A63B 53/06
11,110,325 B2 9/2021 Spackman
11,479,656 B2 10/2022 Soheilian
11,504,587 B2 * 11/2022 Tsunashima ..... A63B 53/042
2006/0046868 A1 3/2006 Murphy
2007/0049403 A1 3/2007 Chen
2008/0004131 A1 1/2008 Lin
2008/0096687 A1 4/2008 Chen
2012/0083361 A1 4/2012 Beach
2013/0040756 A1 * 2/2013 Myrhum ..... A63B 53/0466 473/342
2013/0040757 A1 * 2/2013 Deshmukh ..... A63B 53/0466 473/342
2014/0073450 A1 * 3/2014 Hebreo ..... B21K 17/00 473/342
2014/0148271 A1 * 5/2014 Myrhum ..... A63B 53/0466 473/342
2014/0274446 A1 9/2014 Greaney
2014/0323240 A1 * 10/2014 Myrhum ..... B21K 17/00 72/340
2015/0111664 A1 * 4/2015 Myrhum ..... A63B 60/00 473/342
2015/0119166 A1 * 4/2015 Deshmukh ..... A63B 53/04 473/349
2020/0070017 A1 * 3/2020 Aplin ..... B22F 1/108
2020/0346077 A1 * 11/2020 Aplin ..... B22F 1/108
2020/0391087 A1 12/2020 Su
2021/0008840 A1 1/2021 Gurijala
2021/0154537 A1 * 5/2021 Tsunashima ..... A63B 53/0466

FOREIGN PATENT DOCUMENTS

JP 06304273 A * 11/1994
JP 2005095246 A * 4/2005 ..... A63B 53/0466
JP 2007044253 2/2007
JP 4649958 3/2011
JP 4923718 4/2012
JP 3233491 U * 8/2021 ..... A63B 53/04
KR 200190261 7/2000
KR 2156921 B1 * 9/2020 ..... A63B 53/04
KR 102156921 B1 * 9/2020
WO WO-2005028039 A1 * 3/2005 ..... A63B 53/0466

* cited by examiner

GOLF CLUB HEAD WITH MULTI-MATERIAL CONSTRUCTION

CROSS REFERENCE PRIORITIES

This claims the benefit of U.S. Provisional Application No. 63/218,214, filed Jul. 2, 2021, the entirety of which is incorporated herein by reference.

TECHNICAL FIELD

This disclosure relates generally to golf club heads and, more particularly, relates to golf club heads having a layered, multi-material construction.

BACKGROUND

A golf club head's mass properties can significantly affect performance. Increasing discretionary mass can allow for improved mass placement that may alter a club head's characteristics, such as its center of gravity (CG) and moment of inertia (MOI), thereby leading to improvements in factors such as ball speed, launch angle, travel distance, and forgiveness. One way to reduce club head mass, thereby allowing for freedom to reposition mass as desired, is to replace material in particular regions of the club head with a lighter weight material. Strength, rigidity, performance, and durability of the club head, however, must be maintained when pursuing designs and materials that allow for weight savings in the golf club head.

One of the most important physical parameters is the total mass of the golf club head. The total mass of the golf club head is the sum of the total structural mass and the total discretionary mass. In an ideal club design, structural mass would be minimized (without sacrificing resiliency) to provide sufficient discretionary mass for optional placement to customize and maximize club performance. Structural mass generally refers to the mass of the materials required to provide the club head with the structural resilience to withstand repeated impacts. Structural mass provides a designer with a relatively low amount of control over specific mass distribution. Conversely, discretionary mass is any additional mass (beyond the minimum structural requirements) that may be added to the club head design solely to customize the performance and/or forgiveness of the club. Providing a lighter, durable, and malleable material option for components of a golf club head would allow for more control and manipulation of structural mass values. Having an option to lower the weight of structural mass components allows for more weight to be reallocated to components of discretionary mass, thus optimizing spin and launch characteristics such as MOI and CG of the golf club head.

In relation to prior art designs, structural mass components of golf club heads are very thin titanium walls, composite shells and layers, or combinations of separate metal and composite components of the golf club head. These material options have worked to minimize mass; however, they are susceptible to denting and have other durability issues with the high stresses and impact levels golf clubs undergo. Thus, there is a need in the art for a material combination that allows for targeted mass reduction in particular regions of the club head while maintaining strength, rigidity, and durability.

BRIEF DESCRIPTION OF THE DRAWINGS

To facilitate further description of the embodiments, the following drawings are provided in which.

Figure 1:
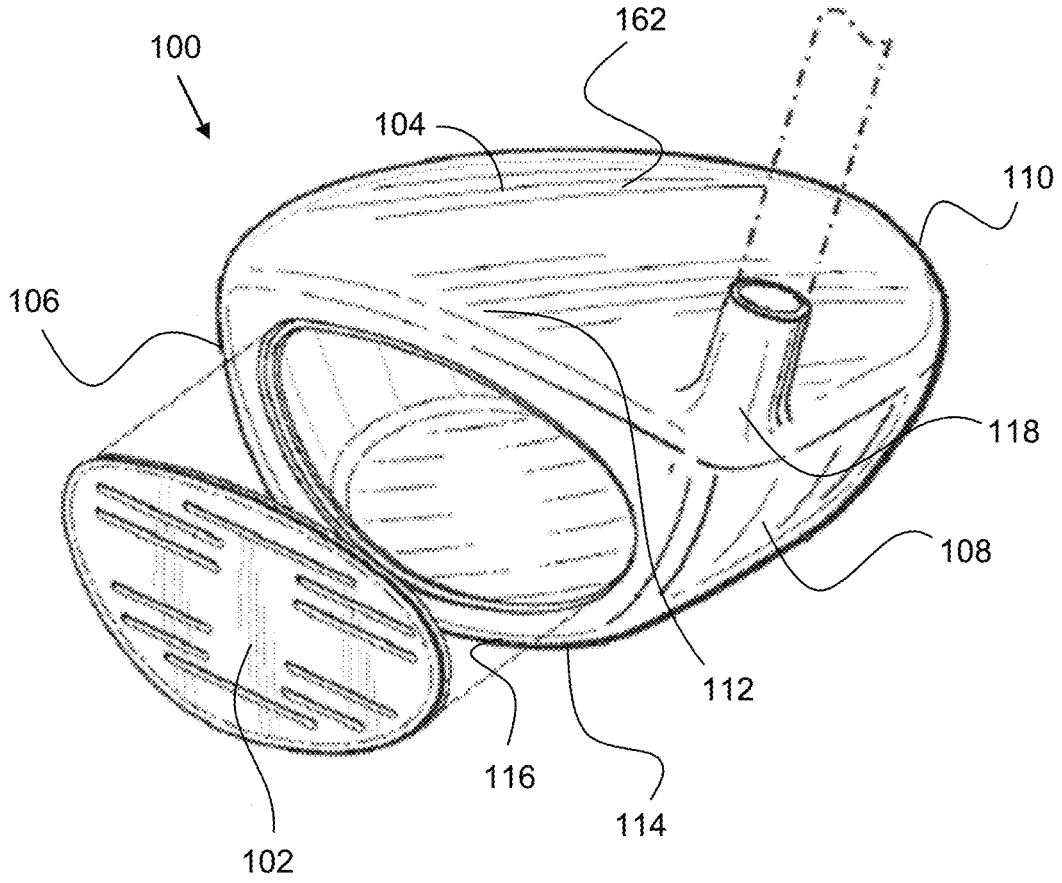
FIG. 1 illustrates an exploded perspective view of a wood-type golf club head body and a faceplate, according to a first embodiment.

Other aspects of the disclosure will become apparent by consideration of the detailed description and accompanying drawings. For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denotes the same elements.

DETAILED DESCRIPTION

Below is described a way to save weight by layering a metal-composite-metal, or encased composite within metal, construction in components such as faceplates, face cups, weight channels, channels, and ribs. In embodiments described below, variations of golf club heads comprising a multi-layer composition, comprising a first layer of metal, an encased layer of composite, and a second layer of metal, have been manufactured to enhance mechanical properties, such as strength and durability, while saving weight when compared to all-metal construction or similar all-metal components of a golf club head. The composite layer of the metal-composite-metal material described herein incorporates a plurality of uni- or multi-directional fibers. The fiber orientation of the composite can contribute to the strength, durability, and flexural properties required to withstand the high stresses and impact typical of a golf club head. The metal-composite-metal construction achieves the resilience and weight ratios not achieved by metal or composite constructions alone. Utilizing the metal-composite-metal in the faceplate, specifically, can improve strength and durability by up to 115% (total of hits until failure) when compared to stock titanium (Ti).

In some embodiments, the metal-composite-metal panel can replace traditional materials used in any one or combination of the following structures or constructions: face plate, channels, slits, ribs, turbulators, weight channel support structures and inserts. The metal-composite-metal material can replace traditional materials used in any region of the golf club head that typically requires built-up material for strength, or any region where mass reductions are desirable. Utilizing the metal-composite-metal in one or more structures can reduce mass by up to 50% compared to all-metal constructions.

Implementation of multi-directional fiber composites can produce new stiffness, strength, and durability advantages unseen in unidirectional fiber composites alone. Orientation of the composite fibers, their make-up from a molecular standpoint, and side chain chemistry of the composites can also be used to craft certain stiffnesses and strengths. Pairing multi-directional fiber composites with metal sheets can produce similar material properties to the metals utilized in golf club heads while saving total mass. A tailoring of these layers is conceived by this disclosure.

Discretionary mass can be placed at various locations within and external to the club head. For golf club heads, adjusting discretionary mass components can improve center of gravity (CG) positioning and increase moment of inertia (MOI). In driver-type club heads, it can be desirable to maximize club head MOI and move CG lower downward and further back. In iron-type and fairway wood club heads, a low and forward club head center of gravity can be desirable because a low and forward center of gravity is known to improve ball speed and spin characteristics. Implementation of a light-weight material that has similar performance properties to traditional structural mass elements, like Ti, would allow for more opportunities to introduce discretionary mass elements and improve golf club performance in drivers, fairway woods, hybrids, irons, and putters.

Definitions

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

A," "an," "the," "at least one," and "one or more" are described herein and interchangeable, indicating that at least one of the items is present; a plurality of such items can be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that can arise from ordinary methods of measuring and using such parameters. In addition, disclosure of ranges includes disclosure of all values and further divided ranges within the entire range. Each value within a range and the endpoints of a range are hereby all disclosed as a separate embodiment. The terms "comprises," "comprising," "including," and "having" are inclusive and therefore specify the presence of stated items but do not preclude the presence of other items. As used in this specification, the term "or" includes any and all combinations of one or more of the listed items. When the terms first, second, third, etc., are used to differentiate various items from each other, these designations are merely for convenience and do not limit the items.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the MCM construction described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

The term "characteristic time" (hereafter "CT") is used herein to mean a measurement used to determine the amount of time, measured in microseconds (μs), that a golf ball contacts the club face at the moment of impact. The characteristic time is measured by impacting a specific spot on the striking surface several times using a small steel pendulum. The characteristic time measurement is for wood-type club heads such as drivers, fairway woods, or hybrids. A computer program measures the amount of time the steel pendulum contacts the club face at the moment of impact. CT values were based on the method outlined in the USGA's Procedure for Measuring the Flexibility of a Golf Clubhead. For example, Section 2 of the USGA's Procedure for Measuring the Flexibility of a Golf Clubhead (USGA-TPX3004, Rev. 2.0, Apr. 9, 2019) (the "Protocol For Measuring The Flexibility of A Golf Club Head").

The term "coefficient of restitution" or "COR" is used herein to mean a measurement used to determine the energy transferred from the club head to the golf ball at impact. The inbound and outbound velocity of a calibrated golf ball being propelled at a clubhead are recorded. These velocities and the mass of the clubhead and the ball are utilized to calculate the COR of a clubhead. COR values were based on the method outlined in the USGA's Procedure for Measuring the Coefficient of Restitution of a Golf Clubhead. For example, Section 2 of the USGA's Procedure for Measuring the Coefficient of Restitution of a Golf Clubhead (USGA-TPX3009, Rev. 2.0, Apr. 9, 2019) (the "Protocol for Measuring the Coefficient of Restitution of a Clubhead Relative to a Baseline Plate").

The term "face cup," as described herein, is defined as to a component configured to be permanently affixed to an aperture positioned in a front portion the golf club head body.

The term "face height," as used herein, is defined as a distance measured parallel to loft plane between a top end of the strikeface perimeter and a bottom end of the strikeface perimeter.

The term "face plane," as used herein, is defined as a reference plane that is tangent to the geometric centerpoint of the strike face.

The term "flexural modulus," as used herein, is the ratio of stress to strain in flexural deformation. The modulus is used to describe a material's stiffness and it's ability to resist bending The term "geometric centerpoint," as used herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face.

The term "ground plane," as used herein, is defined as a reference plane associated with the surface on which a golf ball is placed. The ground plane can be a horizontal plane tangent to the sole at an address position.

The term "leading edge," as used herein, is defined as the most sole-ward portion of the strike face perimeter. For example, a fairway-type golf club head leading edge is the transition from the roll and bulge of the strike face to the sole of the fairway-type golf club head.

The term "lie angle," as used herein, is defined as angle between a hosel axis, extending through the hosel, and the ground plane. The lie angle is measured from a front view.

The term "loft plane," as used herein, is defined as a reference plane that is tangent to the geometric centerpoint of the strike face.

The term "loft angle," as used herein, is defined as an angle measured between the ground plane and the loft plane.

The terms "modulus of elasticity," or "Young's Modulus," as described herein, is the ratio of stress to strain and is the slope (E) of the stress-strain curve in the elastic region. The modulus is used to describe a material's stiffness.

The term "moment of inertia" (hereafter "MOI") can refer to values measured about the CG. The term "Ixx" can refer to the MOI measured in the heel-to-toe direction, parallel to the X-axis. The term "Iyy" can refer to the MOI measured in the sole-to-top rail (or sole-to-crown) direction, parallel to the Y-axis. The term "Izz" can refer to the MOI measured in the front-to-back direction, parallel to the Z-axis. The MOI values Ixx, Iyy, and Izz determine how forgiving the club head is for off-center impacts with a golf ball.

The term "strike face," as used herein, refers to a club head front surface that is configured to strike a golf ball. The term strike face can be used interchangeably with the "face."

The term "strike face perimeter," as used herein, can refer to an edge of the strike face. The strike face perimeter can be located along an outer edge of the strike face where the curvature deviates from a bulge and/or roll of the strike face.

The "strike face thickness" of the golf club head, as defined herein and used below, is measured from the strike front surface to the strike face rear surface. The strike face thickness can vary in a toe to heel direction and in a crown to sole direction.

An "XYZ" coordinate system of the golf club head, as described herein, is based upon the geometric center of the strike face. The club head dimensions as described herein can be measured based on a coordinate system as defined below. The geometric center of the strike face defines a coordinate system having an origin located at the geometric center of the strike face. The coordinate system defines an X axis, a Y axis, and a Z axis. The X axis extends through the geometric center of the strike face in a direction from the heel to the toe of the club head. The Y axis extends through the geometric center of the strike face in a direction from the crown to the sole of the club head. The Y axis is perpendicular to the X axis. The Z axis extends through the geometric center of the strike face in a direction from the front end to the rear end of the club head. The Z axis is perpendicular to both the X axis and the Y axis.

The XYZ coordinate system of the golf club head, as described herein defines an XY plane extending through the X axis and the Y axis. The coordinate system defines XZ plane extending through the X axis and the Z axis. The coordinate system further defines a YZ plane extending through the Y axis and the Z axis. The XY plane, the XZ plane, and the YZ plane are all perpendicular to one another and intersect at the coordinate system origin located at the geometric center of the strike face. The XY plane extends parallel to the hosel axis and is positioned at an angle corresponding to the loft angle of the club head from the loft plane.

"Drivers golf club heads" as used herein comprise a loft angle less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, "driver golf club heads" as used herein comprises a volume greater than approximately 400 cc, greater than approximately 425 cc, greater than approximately 445 cc, greater than approximately 450 cc, greater than approximately 455 cc, greater than approximately 460 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

"Fairway wood golf club heads" as used herein comprise a loft angle less than approximately 35 degrees, less than approximately 34 degrees, less than approximately 33 degrees, less than approximately 32 degrees, less than approximately 31 degrees, or less than approximately 30 degrees. Further, in some embodiments, the loft angle of the fairway wood club heads can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in other embodiments, the loft angle of the fairway wood can be between 12 degrees and 35 degrees, between 15 degrees and 35 degrees, between 20 degrees and 35 degrees, or between 12 degrees and 30 degrees.

Further, "fairway wood golf club heads" as used herein comprises a volume less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the fairway wood can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

"Hybrid golf club heads" as used herein comprise a loft angle less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Further, "hybrid golf club heads" as used herein comprise a volume less than approximately 200 cc, less than approximately 175 cc, less than approximately 150 cc, less than approximately 125 cc, less than approximately 100 cc, or less than approximately 75 cc. In some embodiments, the volume of the hybrid can be approximately 100 cc-150 cc, approximately 75 cc-150 cc, approximately 100 cc-125 cc, or approximately 75 cc-125 cc.

The term "iron," as used herein, can, in some embodiments, refer to an iron-type golf club head having a loft angle that is less than approximately 60 degrees, less than approximately 59 degrees, less than approximately 58 degrees, less than approximately 57 degrees, less than approximately 57 degrees, less than approximately 56 degrees, less than approximately 55 degrees, less than approximately 54 degrees, less than approximately 53 degrees, less than approximately 52 degrees, less than approximately 51 degrees, less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

The volume of the iron can be greater than or equal to 20 cubic centimeters (cc) and less than or equal to 80 cubic centimeters (cc). In some embodiments, the volume of the iron can range from 20 to 50 cc, or 50 to 80 cc. In other embodiments, the volume of the iron can range from 20 to 60 cc, 30 to 70 cc, or 40 to 80 cc. For example, the volume of the iron can be 20, 30, 40, 50, 60, 70, or 80 cc.

The term "putter," can, in some embodiments, refer to a putter-type club head having a loft angle less than 10 degrees. In many embodiments, the loft angle of the putter can be between 0 and 5 degrees, between 0 and 6 degrees, between 0 and 7 degrees, or between 0 and 8 degrees. For example, the loft angle of the club head can be less than 10 degrees, less than 9 degrees, less than 8 degrees, less than 7 degrees, less than 6 degrees, or less than 5 degrees. For further example, the loft angle of the club head can be 0 degrees, 1 degree, 2 degrees, 3 degrees, 4 degrees, 5 degrees, 6 degrees, 7 degrees, 8 degrees, 9 degrees, or 10 degrees. The putter-type golf club head can be a blade type putter, a mid-mallet type putter, a mallet type putter. It should be understood that the principles and structures described for the mid-mallet type putter can be applied in a blade type putter and/or a mallet type putter without departing from the scope of this disclosure.

Metal-Composite-Metal Panel 326 Construction

Described herein is a metal-composite-metal construction (hereafter referred to as "MCM" construction, composition, material, panel 326, portion, or sandwich) 326, in which a composite material layer 332 is sandwiched between metal layers (330, 334). The MCM panel 326 can be used in various components of a golf club head and can comprise a combination of metal and composite materials. The use of uni-direction fibers, multi-directional fibers, or a combination of uni- and multi-directional fibers in the composite layer 332 is a method of introducing specific mechanical tensiles and maintaining mechanical properties, such as strength, durability, and rigidity, while saving weight in a golf club head when compared to all-metal construction. Fibers can be oriented in the x-direction, y-direction, z-direction, or any combination of these directions. Incorporating fibers oriented in the z-direction can further increase strength and rigidity of the MCM panel 326. Due to the MCM panel's 326 structure, the composite experiences minimal stress, has a minimal influence on the bending behavior of the construction, and mimics the bending properties of stock, all-metal constructions; making it an ideal, weight-saving substitute for currently utilized metals for components of the golf club head. In one example, a MCM panel 326 comprising a layer of Ti 6-4 having a thickness of 0.05 inch, or 0.025 to 0.0925 inch, combined with a layer of fiber-reinforced PEI having a thickness of 0.025 inch, or 0.020 to 0.275 inch, and another layer of Ti 6-4 having a thickness of 0.05 inch, or 0.025 to 0.0925 inch, had comparable properties and characteristic to a stock Ti sample.

The MCM panel 326 can comprise three layers. The first layer 330 can comprise a metallic material, the second layer 332 can comprise a composite material, and the third layer 334 can comprise a metallic material. In some embodiments, the first and third (metallic material) layers (330, 334) are the same material. In other embodiments, the first and third metallic layer (330, 334) materials can differ from one another. The second layer 332 material is different from the first- and third-layer (330, 334) materials.

Layer 1 of the MCM Panel-Metal

First Layer Materials

The first layer 330 (also referred to as "layer 1") can be made up of a metallic material. The first layer 330 material can be one or any combination of the following: titanium (Ti), titanium alloy (e.g. Ti-6-4, Ti-8-1-1, T-9S, or BE α-β Ti alloy), aluminum (Al), aluminum alloy, steel, steel alloy, tin, tin alloy, or any other suitable metallic material. In one example, the first layer 330 material is the titanium alloy Ti-6-4 and the club head body 162 material is the titanium alloy Ti-8-1-1.

First Layer Thickness

The first layer 330 can have a first layer thickness. In many embodiments, the first layer 330 thickness can be uniform across the panel 326. In other embodiments, it can vary across the panel 326. In some embodiments, the thickness of the first layer 330 can be between 0.0025 and 0.0925 inch. In some examples, the first layer 330 can be between 0.0025 and 0.0075, 0.0075 and 0.0125, 0.0125 and 0.0175, 0.0175 and 0.0225, 0.0225 and 0.0275, 0.0275 and 0.0325, 0.0325 and 0.0375, 0.0375 and 0.0425, 0.0425 and 0.0475, 0.0475 and 0.0525, 0.0525 and 0.0575, 0.0575 and 0.0625, 0.0625 and 0.0675, 0.0675 and 0.0725, 0.0725 and 0.0775 inch, 0.0775 and 0.0825, 0.0825 and 0.0875, or 0.0875 and 0.0925 inch.

In some embodiments, the thickness of the first layer 330 can be up to 0.0025, 0.0075, 0.0125, 0.0175, 0.0225, 0.0275, 0.0325, 0.0375, 0.0425, 0.0475, 0.0525, 0.0575, 0.0625, 0.0675, 0.0725, 0.0775, 0.0825, 0.0875, or 0.0925 inch. In some embodiments, the thickness of the first layer 330 can be at least 0.0025, 0.0075, 0.0125, 0.0175, 0.0225, 0.0275, 0.0325, 0.0375, 0.0425, 0.0475, 0.0525, 0.0575, 0.0625, 0.0675, 0.0725, 0.0775, 0.0825, 0.0875, or 0.0925 inch. In some embodiments, the thickness of the first layer 330 can be greater than or equal to 0.0025, 0.0075, 0.0125, 0.0175, 0.0225, 0.0275, 0.0325, 0.0375, 0.0425, 0.0475, 0.0525, 0.0575, 0.0625, 0.0675, 0.0725, 0.0775, 0.0825, 0.0875, or 0.0925 inch. In some embodiments, the thickness of the first layer 330 can be less than or equal to 0.0025, 0.0075, 0.0125, 0.0175, 0.0225, 0.0275, 0.0325, 0.0375, 0.0425, 0.0475, 0.0525, 0.0575, 0.0625, 0.0675, 0.0725, 0.0775, 0.0825, 0.0875, or 0.0925 inch. For example, the thickness of the first layer 330 can 0.0025, 0.0075, 0.0125, 0.0175, 0.0225, 0.0275, 0.0325, 0.0375, 0.0425, 0.0475, 0.0525, 0.0575, 0.0625, 0.0675, 0.0725, 0.0775, 0.0825, 0.0875, or 0.0925 inch. In other examples, the thickness of the first layer 330 can be 0.005, 0.010, 0.015, 0.020, 0.025, 0.030, 0.035, 0.040, 0.045, 0.050, 0.055, 0.060, 0.065, 0.070, 0.075, 0.080, 0.085, or 0.090 inch.

Layer 2 of the MCM Panel-Composite

Second Layer Overview

The second layer 332 (also referred to as "layer 2") can be made up of a composite material comprising a plurality of uni-direction fibers, multi-directional fibers, or a combination of uni- and multi-directional fibers that are aligned and layered relative to the x-axis, y-axis or z-axis. The material and orientation of the composite fibers 224 have strength and weight ratio properties to be able to withstand the high stresses and impact typical of a golf club head. The second layer 332 material can be less dense, lighter weight, and/or more flexible than the first and third layer (330, 334) material(s). The second layer 332 can be used to reduce the volume of heavy metallic material used, thereby reducing the panel's 326 weight, while maintaining strength and durability.

Second Layer Materials

In some embodiments, the polymer making up a portion of the fiber-reinforced composite material of the second layer can be any one or combination of the following materials: polyethylenimine (PEI), polyphthalamide (PPA), polyphenylene (PPS), polyether ether ketone (PEEK), polyaryletherketone (PAEK), thermoplastic polyurethane (TPU), Nylon 6 (6-6, 11, 12), polyimide (PI), polyamide-imide (PAI), polyetherketone (PEK), polyphenylesulfone (PPSU), polyethersulfone (PSU), polyvinylidene fluoride (PVDF), polytetrafluoroethylene (PTFE), perfluoroalkoxy alkanes (PFA), polyamide 46 (P46), polyamide 66 (PA66), polyamide 12 (PA12), polyamide 11 (PA11), polyamide 6 (PA6), polyamide 6.6 (PA6.6), polyamide 6.6/6 (PA6.6/6), amorphous polyamide (PA6-3-T), polyethylene terephthalate (PET), liquid crystal polymer (LCP), polycarbonate (PC), polybutylene terephthalate (PBT), polyoxymethylene (POM), polyphenyl ether (PPE), polymethylmethacrylate (PMMA), polypropylene (PP), polymethylene (PE), high density polyethylene (HDPE), acrylonitrile styrene acrylate (ASA), styrene acrylonitrile (SAN), acrylonitrile butadiene styrene (ABS), polybenzimidazole (PBI), polyvinyl chloride (PVC), poly-para-phenylene-copolymer (PPP), polyacrylonitrile, polyethylenimine, polyetherketonetherketoneketone (PEKEKK), ethylene tetrafluoroethylene (ETFE), polychlorotrifluoroethylene (PCTFE), or polymethylpentene (PMP).

The composite comprises fibers that can include any one or combination of the following materials: polymer, synthetic, and natural fibers. In some embodiments, the fibers can be carbon fiber, glass fiber, Kevlar fiber, ultra-high molecular weight polyethylene (UHMWPE) fiber, basalt fiber, silicon fiber, carbide fiber, aramid fiber, zirconia fiber, boron fiber, alumina fiber, silica fiber, borosilicate fiber, mullite fiber, cotton fiber, or any other suitable natural or synthetic fiber. In one example, the second layer 332 material is a thermoplastic polymer matrix reinforced with carbon fiber.

The composite's composition can vary with different volumes of fiber material between polymer fibers and other suitable fibers as identified above. In some embodiments, the volume of the composite may be made of at least 30%, at least 40%, at least 50%, at least 60%, at least 70%, at least 80%, at least 90%, at least 95%, at least 97%, or at least 99% of a polymer material, while the remaining percent volume is of a suitable natural or synthetic fiber material. In other examples, the volume of polymer present in the composite can be between 30% and 35%, 35% and 40%, 40% and 45%, 45% and 50%, 50% and 55%, 55% and 60%, 60% and 65%, 65% and 70%, 70% and 75%, 75% and 80%, 80% and 85%, 85% and 90%, 90% and 95%, or 95% and 100%.

Fiber Orientations

Figure 2A:
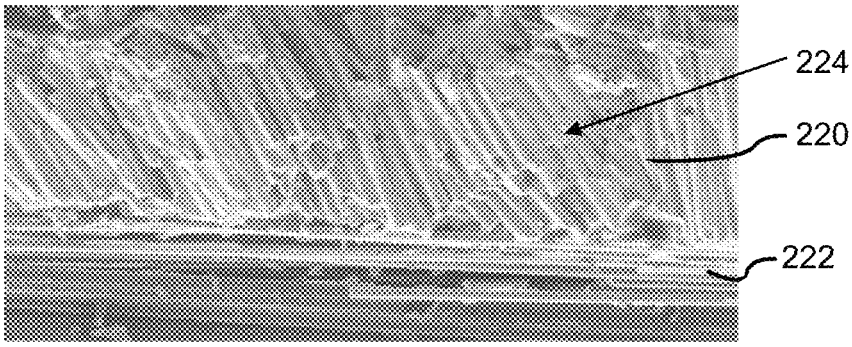
FIG. 2A illustrates a scanning electron microscope (SEM) image of a cross-section view of a MCM panel comprising horizontal and z-oriented fibers, according to one embodiment.
Figure 2B:
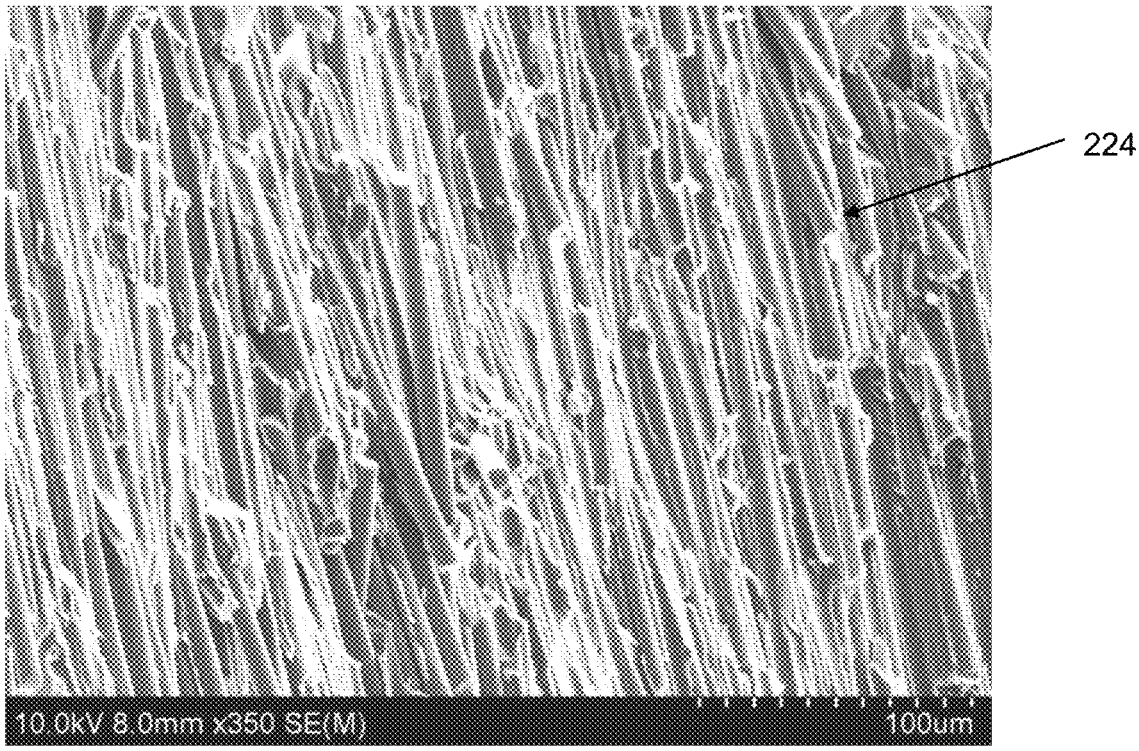
FIG. 2B illustrates an SEM image of a cross-section view of a MCM panel comprising z-oriented fibers, according to one embodiment.

Referring to FIGS. 2A and 2B wherein like reference numerals are used to identify components of the second layer 332. The second layer's fibers can be unidirectional, multidirectional, or a combination of both unidirectional and multidirectional. In some embodiments, multiple sets of unidirectional fibers can be oriented in a combination of more than one direction.

In one embodiment, the second layer 332 comprises horizontal fibers 222 and z-oriented fibers 220. The horizontal fibers 222 can be oriented in a horizontal fiber's axis, either an x-direction (parallel to the x-axis) or a y-direction (parallel to the y-axis). In one example, the horizontal fibers 222 can be made up as a unidirectional tape. In some embodiments, the horizontal fibers 222 can be formed by a roll-to-roll process. In the illustrated embodiment, the horizontal fibers 222 are oriented in an x-direction. In other embodiments, the horizontal fibers 222 can be oriented in a y-direction. In other embodiments still, one layer of horizontal fibers 222 can be oriented in a x-direction while another layer of horizontal fibers 222 is oriented in a y-direction. The composite layer 332 of the MCM sandwich 326 is made up of three or more layers of fibers. In some embodiments, two thin sheets of long horizontal fibers 222 cover the sides of the composite layer 332 that contact the metal layers (layer 1 and layer 3 of the MCM sandwich 326) (330, 334). The combined layers of unidirectional fibers aligned in the horizontal direction with the z-oriented fibers 220 form a composite laminate. Multiple composite laminates can be combined to increase thickness to a desired amount.

In between the two x- or y-oriented horizontal fiber sheets, there can be a plurality of short fibers oriented in the z-direction (parallel to the z-axis). Fibers are magnetically aligned in the z-direction at an approximate range of 45 degrees to 90 degrees relative to the horizontal fibers' axis. In some examples, 70% to 100% of the fibers are oriented in the z-direction within the approximate range of 45 degrees to 90 degrees (relative to the horizontal fibers' axis). The z-oriented fibers 220 can be substantially parallel with one another and substantially perpendicular to the horizontal fibers 222. Some fibers may slip during manufacturing and, as a result, can be oriented nearly perpendicular to the z-oriented fibers 220. The ends of each z-oriented fiber 220 can contact, or nearly contact, one of the x- or y-oriented horizontal fiber 222 sheets.

In some embodiments, at least 70% of the z-oriented fibers 220 fall 45 degrees relative to, 50 degrees relative to, 55 degrees relative to, 60 degrees relative to, 65 degrees relative to, 70 degrees relative to, 75 degrees relative to, 80 degrees relative to, 85 degrees relative to, or 90 degrees relative to the horizontal fibers' axis (e.g. x- or y-axis).

In some embodiments, at least 75% of the z-oriented fibers 220 fall 45 degrees relative to, 50 degrees relative to, 55 degrees relative to, 60 degrees relative to, 65 degrees relative to, 70 degrees relative to, 75 degrees relative to, 80 degrees relative to, 85 degrees relative to, or 90 degrees relative to the horizontal fibers' axis.

In some embodiments, at least 80% of the z-oriented fibers 220 fall 45 degrees relative to, 50 degrees relative to, 55 degrees relative to, 60 degrees relative to, 65 degrees relative to, 70 degrees relative to, 75 degrees relative to, 80 degrees relative to, 85 degrees relative to, or 90 degrees relative to the horizontal fibers' axis.

In some embodiments, at least 85% of the z-oriented fibers 220 fall 45 degrees relative to, 50 degrees relative to, 55 degrees relative to, 60 degrees relative to, 65 degrees relative to, 70 degrees relative to, 75 degrees relative to, 80 degrees relative to, 85 degrees relative to, or 90 degrees relative to the horizontal fibers' axis.

In some embodiments, at least 90% of the z-oriented fibers 220 fall 45 degrees relative to, 50 degrees relative to, 55 degrees relative to, 60 degrees relative to, 65 degrees relative to, 70 degrees relative to, 75 degrees relative to, 80 degrees relative to, 85 degrees relative to, or 90 degrees relative to the horizontal fibers' axis.

In some embodiments, at least 95% of the z-oriented fibers 220 fall 45 degrees relative to, 50 degrees relative to, 55 degrees relative to, 60 degrees relative to, 65 degrees relative to, 70 degrees relative to, 75 degrees relative to, 80 degrees relative to, 85 degrees relative to, or 90 degrees relative to the horizontal fibers' axis.

In some embodiments, at least 97% of the z-oriented fibers 220 fall 45 degrees relative to, 50 degrees relative to, 55 degrees relative to, 60 degrees relative to, 65 degrees relative to, 70 degrees relative to, 75 degrees relative to, 80 degrees relative to, 85 degrees relative to, or 90 degrees relative to the horizontal fibers' axis.

In some embodiments, at least 100% of the z-oriented fibers 220 fall 45 degrees relative to, 50 degrees relative to, 55 degrees relative to, 60 degrees relative to, 65 degrees relative to, 70 degrees relative to, 75 degrees relative to, 80 degrees relative to, 85 degrees relative to, or 90 degrees relative to the horizontal fibers' axis.

In some embodiments, the z-oriented fibers 220 may comprise a varying portion of the composite's total mass. In some examples, the z-oriented fibers 220 may comprise at least 1%, at least 2%, at least 3%, at least 4%, at least 5%, at least 10%, at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, at least 95%, or at least 97% of the composite's total mass composition. In one example, the z-oriented fibers 220 comprise 50% of the composite's total mass. In another example, the z-oriented fibers 220 comprise 67% of the composite's total mass.

Fiber Dimensions

In some embodiments the z-oriented fibers 220 may be between 0.050 to 0.20 mm in length. In some embodiments the fibers can be between 0.050 and 0.055, 0.055 and 0.060, 0.060 and 0.065, 0.065 and 0.070, 0.070 and 0.075, 0.075 and 0.080, 0.080 and 0.085, 0.085 and 0.090, 0.090 and 0.095, 0.095 and 0.100, 0.100 and 0.105, 0.105 and 0.110, 0.110 and 0.115, 0.115 and 0.120, 0.120 and 0.125, 0.125 and 0.130, 0.130 and 0.135, 0.135 and 0.140, 0.140 and 0.145, 0.145 and 0.150, 0.150 and 0.155, 0.155 and 0.160, 0.160 and 0.165, 0.165 and 0.170, 0.170 and 0.175, 0.175 and 0.180, 0.180 and 0.185, 0.185 and 0.190, 0.190 and 0.195, or 0.195 and 0.200 mm in length. In some embodiments, the z-oriented fibers 220 can be at least 0.050, 0.060, 0.070, 0.080, 0.090, 0.100, 0.110, 0.120, 0.130, 0.140, 0.150, 0.160, 0.170, 0.180, 0.190, or at least 0.200 mm in length. In some embodiments, the z-oriented fibers 220 can be up to 0.050, 0.060, 0.070, 0.080, 0.090, 0.100, 0.110, 0.120, 0.130, 0.140, 0.150, 0.160, 0.170, 0.180, 0.190, or up to 0.200 mm in length. In some embodiments, the z-oriented fibers 220 can be greater than or equal to 0.050, 0.060, 0.070, 0.080, 0.090, 0.100, 0.110, 0.120, 0.130, 0.140, 0.150, 0.160, 0.170, 0.180, 0.190, or greater than or equal to 0.200 mm in length. In some embodiments, the z-oriented fibers 220 can be less than or equal to 0.050, 0.060, 0.070, 0.080, 0.090, 0.100, 0.110, 0.120, 0.130, 0.140, 0.150, 0.160, 0.170, 0.180, 0.190, or less than or equal to 0.200 mm. In one example, the z-oriented fibers 220 are between 0.085 and 0.115 mm in length.

The fibers oriented in the x- or y-direction generally are longer in length on average compared to the fibers oriented in the z-direction. In some embodiments, the x- and y-oriented fibers (horizontal fibers 222) can be at least 5 mm, 1 cm, 2 cm, 3 cm, 4 cm, 5 cm, 6 cm, 7 cm, 8 cm, 9 cm, or at least 10 cm in length. In some embodiments, the x- and y-oriented fibers (horizontal fibers 222) can be up to 5 mm, 1 cm, 2 cm, 3 cm, 4 cm, 5 cm, 6 cm, 7 cm, 8 cm, 9 cm, or up to 10 cm in length. In some embodiments, the x- and y-oriented fibers (horizontal fibers 222) can be greater than or equal to 5 mm, 1 cm, 2 cm, 3 cm, 4 cm, 5 cm, 6 cm, 7 cm, 8 cm, 9 cm, or greater than or equal to 10 cm in length. In some embodiments, the x- and y-oriented fibers (horizontal fibers 222) can be less than or equal to 5 mm, 1 cm, 2 cm, 3 cm, 4 cm, 5 cm, 6 cm, 7 cm, 8 cm, 9 cm, or less than or equal to 10 cm in length. Longer average lengths for these fibers are also possible. In some examples, the x- or y-oriented fibers (horizontal fibers 222) can have a length that can be as long as the entire length of the side to which they are parallel.

In some embodiments, the x-, y-, and z-oriented fibers may have an average diameter between 0.010 mm to 0.250 mm. In some examples the fibers can be between 0.010 mm and 0.020 mm, 0.020 mm and 0.030 mm, 0.030 mm and 0.040 mm, 0.040 mm and 0.050 mm, 0.050 mm and 0.060 mm, 0.060 mm and 0.070 mm, 0.070 mm and 0.080 mm, 0.080 mm and 0.090 mm, 0.090 mm and 0.100 mm, 0.100 mm and 0.110 mm, 0.110 mm and 0.120 mm, 0.120 mm and 0.130 mm, 0.130 mm and 0.140 mm, 0.140 mm and 0.150 mm, 0.150 mm and 0.160 mm, 0.160 mm and 0.170 mm, 0.170 mm and 0.180 mm, 0.180 mm and 0.190 mm, 0.190 mm and 0.200 mm, 0.200 mm and 0.210 mm, 0.210 mm and 0.220 mm, 0.220 mm and 0.230 mm, 0.230 mm and 0.240 mm, and 0.240 mm and 0.250 mm. In other examples, the x-, y-, and z-oriented fibers may have an average diameter of at least 0.010 mm, at least 0.020 mm, at least 0.030 mm, at least 0.040 mm, at least 0.050 mm, at least 0.060 mm, at least 0.070 mm, at least 0.080 mm, at least 0.090 mm, at least 0.100 mm, at least 0.110 mm, at least 0.120 mm, at least 0.130 mm, at least 0.140 mm, at least 0.150 mm, at least 0.160 mm, at least 0.170 mm, at least 0.180 mm, at least 0.190 mm, at least 0.200 mm, at least 0.210 mm, at least 0.220 mm, at least 0.230 mm, at least 0.240 mm, or at least 0.250 mm.

Typically, the fibers have a length that, on average, is substantially longer than the cross-sectional diameter. Thus, in some embodiments, the length of the fiber is 10 times greater than, 50 times greater than, 100 times greater than, 250 times greater than, 500 times greater than, or 1000 times greater than the cross-sectional diameter of the fiber.

Second Layer Thickness

In some embodiments, the thickness of the second layer 332 can be between 0.020 and 0.275 inch. In some embodiments, the second layer 332 can be between 0.020 and 0.050, 0.045 and 0.075, 0.070 and 0.100, 0.095 and 0.125, 0.120 and 0.150, 0.145 and 0.175, 0.170 and 0.200, 0.195 and 0.225, 0.220 and 0.250, or 0.245 and 0.275 inch.

In some embodiments, composite laminates having a pre-determined thickness can be layered and coupled to form a laminate having a desired thickness. In some embodiments, each laminate layer can be 0.025 inch. In these and other embodiments, the thickness of the second layer 332 can be approximately 0.025, 0.050, 0.075, 0.100, 0.125, 0.150, 0.175, 0.200, 0.225, 0.250, or 0.275 inch. In some embodiments, the thickness of the second layer 332 can be at least 0.025, 0.050, 0.075, 0.100, 0.125, 0.150, 0.175, 0.200, 0.225, 0.250, or 0.275 inch. In some embodiments, the thickness of the second layer 332 can be greater than or equal to 0.025, 0.050, 0.075, 0.100, 0.125, 0.150, 0.175, 0.200, 0.225, 0.250, or 0.275 inch. In some embodiments, the thickness of the second layer 332 can be less than or equal to 0.025, 0.050, 0.075, 0.100, 0.125, 0.150, 0.175, 0.200, 0.225, 0.250, or 0.275 inch. For example, the thickness of the second layer 332 can be 0.025, 0.050, 0.075, 0.100, 0.125, 0.150, 0.175, 0.200, 0.225, 0.250, or 0.275 inch.

Layer 3 of the MCM Panel-Metal

Layer 3 Materials

The third layer 334 (also referred to as "layer 3") materials can be one or any combination of the following: titanium (Ti), titanium alloy (e.g. Ti-6-4, Ti-8-1-1, T-9S, or BE $\alpha$-$\beta$ Ti alloy), aluminum (Al), aluminum alloy, steel, steel alloy, tin, tin alloy, or any other suitable metallic material. In one example, the third layer 334 material is the titanium alloy Ti-6-4 and the body material is the titanium alloy Ti-8-1-1. In some embodiments, the third layer 334 can have the same material as the first layer. In other embodiments, the first and third layers (330, 334) are made up of different materials.

Layer 3 Thickness

Figure 3A:
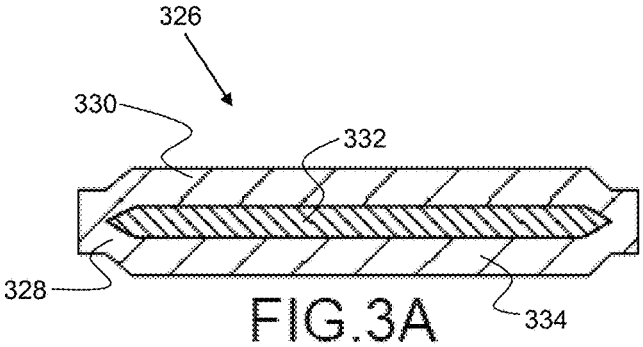
FIG. 3A illustrates a cross-section view of a MCM panel, according to a first embodiment.
Figure 3B:
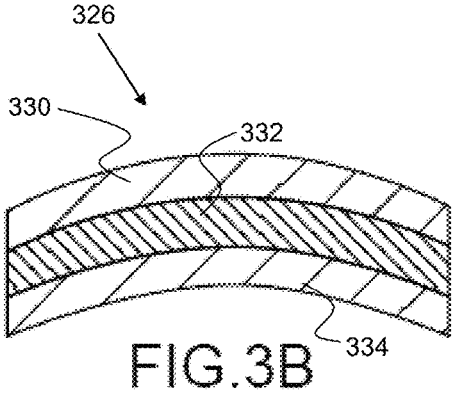
FIG. 3B illustrates a cross-section view of a MCM panel, according to a second embodiment.
Figure 3C:
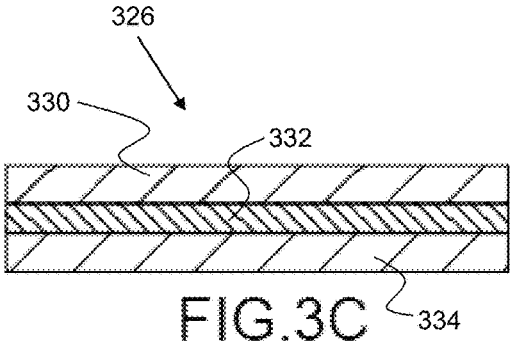
FIG. 3C illustrates a cross-section view of a MCM panel, according to a third embodiment.
Figure 3D:
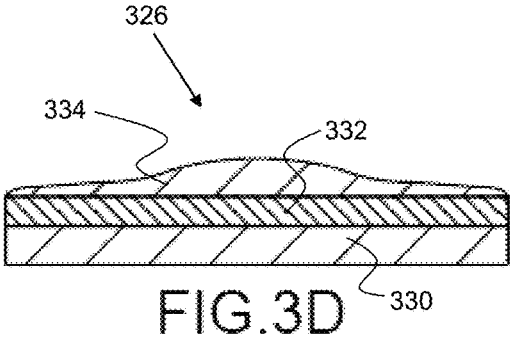
FIG. 3D illustrates a cross-section view of a MCM panel, according to a fourth embodiment.

This thickness of the third layer 334 can be uniform across the panel 326, or it can vary across the panel 326. The thickness of the third layer 334 can be the same as the thickness of the first layer 330 or it can be different. In some embodiments (FIG. 3D), the first layer 330 has a uniform thickness, while the third layer 334 has a variable thickness. In other embodiments (FIG. 3C), the first layer has a variable thickness, while the third layer has a uniform thickness.

In some embodiments, the thickness of the third layer 334 can be between 0.0025 and 0.0925 inch. In some embodiments, the third layer 334 can be between 0.0025 and 0.0075, 0.0075 and 0.0125, 0.0125 and 0.0175, 0.0175 and 0.0225, 0.0225 and 0.0275, 0.0275 and 0.0325, 0.0325 and 0.0375, 0.0375 and 0.0425, 0.0425 and 0.0475, 0.0475 and 0.0525, 0.0525 and 0.0575, 0.0575 and 0.0625, 0.0625 and 0.0675, 0.0675 and 0.0725, 0.0725 and 0.0775 inch, 0.0775 and 0.0825, 0.0825 and 0.0875, or 0.0875 and 0.0925 inch.

In some embodiments, the thickness of the third layer 334 can be up to 0.0025, 0.0075, 0.0125, 0.0175, 0.0225, 0.0275, 0.0325, 0.0375, 0.0425, 0.0475, 0.0525, 0.0575, 0.0625, 0.0675, 0.0725, 0.0775, 0.0825, 0.0875, or 0.0925 inch. In some embodiments, the thickness of the third layer 334 can be at least 0.0025, 0.0075, 0.0125, 0.0175, 0.0225, 0.0275, 0.0325, 0.0375, 0.0425, 0.0475, 0.0525, 0.0575, 0.0625, 0.0675, 0.0725, 0.0775, 0.0825, 0.0875, or 0.0925 inch. In some embodiments, the thickness of the third layer 334 can be greater than or equal to 0.0025, 0.0075, 0.0125, 0.0175, 0.0225, 0.0275, 0.0325, 0.0375, 0.0425, 0.0475, 0.0525, 0.0575, 0.0625, 0.0675, 0.0725, 0.0775, 0.0825, 0.0875, or 0.0925 inch. In some embodiments, the thickness of the third layer 334 can be less than or equal to 0.0025, 0.0075, 0.0125, 0.0175, 0.0225, 0.0275, 0.0325, 0.0375, 0.0425, 0.0475, 0.0525, 0.0575, 0.0625, 0.0675, 0.0725, 0.0775, 0.0825, 0.0875, or 0.0925 inch. For example, the thickness of the third layer 334 can 0.0025, 0.0075, 0.0125, 0.0175, 0.0225, 0.0275, 0.0325, 0.0375, 0.0425, 0.0475, 0.0525, 0.0575, 0.0625, 0.0675, 0.0725, 0.0775, 0.0825, 0.0875, or 0.0925 inch. In other examples, the thickness of the third layer 334 can be 0.005, 0.010, 0.015, 0.020, 0.025, 0.030, 0.035, 0.040, 0.045, 0.050, 0.055, 0.060, 0.065, 0.070, 0.075, 0.080, 0.085, or 0.090 inch.

MCM Panel 326

MCM Panel 326 Overview

The first, second, and third layers (330, 332 334), as described above, can be combined to form the MCM panel 326. The second (composite) layer 332 can be positioned, bonded, or encased within the first and third (metallic) layers (330, 334). In some embodiments, the geometries of the first (metallic) layer 330 and the third (metallic) layer 334 can be the same. In some of these embodiments, the two metal layers can be formed to be identical, however, later forming steps, such as stamping, pressing, or machining, may result in differences between the two metal layers. In other embodiments, the first and third layers (330, 334) comprise different geometries, but still work together to encase or sandwich the second layer 332.

MCM Panel 326 Thickness

The thickness of each MCM layer influence the thickness of the sandwich 326 as a whole. Different layer thicknesses work together to produce optimized strength and durability properties required of a golf club head, thus the thickness of the sandwich can vary depending on its application and embodiment. In some embodiments, the MCM portion 326 can be between 0.025 and 0.500 inch (comment). In some embodiments, the MCM portion 326 can be between 0.025 and 0.05, 0.05 and 0.075, 0.075 and 0.100, 0.100 and 0.125, 0.125 and 0.150, 0.150 and 0.175, 0.175 and 0.200, 0.200 and 0.225, 0.225 and 0.250, 0.250 and 0.275, 0.275 and 0.300, 0.300 and 0.325, 0.325 and 0.350, 0.350 and 0.375, 0.375 and 0.400, 0.400 and 0.425, 0.425 and 0.450, 0.450 and 0.475, or 0.475 and 0.500 inch.

In some embodiments, the MCM portion 326 can be up to 0.025, 0.050, 0.075, 0.100, 0.125, 0.150, 0.175, 0.200, 0.225, 0.250, 0.275, 0.300, 0.325, 0.350, 0.375, 0.400, 0.425, 0.450, 0.475, or 0.500 inch. In some embodiments, the MCM portion 326 can be at least 0.025, 0.050, 0.075, 0.100, 0.125, 0.150, 0.175, 0.200, 0.225, 0.250, 0.275, 0.300, 0.325, 0.350, 0.375, 0.400, 0.425, 0.450, 0.475, or at least 0.500 inch. In some embodiments, the MCM portion 326 can be at greater than or equal to 0.025, 0.050, 0.075, 0.100, 0.125, 0.150, 0.175, 0.200, 0.225, 0.250, 0.275, 0.300, 0.325, 0.350, 0.375, 0.400, 0.425, 0.450, 0.475, or greater than or equal to 0.500 inch. In some embodiments, the MCM portion 326 can be less than or equal to 0.025, 0.050, 0.075, 0.100, 0.125, 0.150, 0.175, 0.200, 0.225, 0.250, 0.275, 0.300, 0.325, 0.350, 0.375, 0.400, 0.425, 0.450, 0.475, or less than or equal to 0.500 inch. For example, the MCM portion 326 can be 0.025, 0.050, 0.075, 0.100, 0.125, 0.150, 0.175, 0.200, 0.225, 0.250, 0.275, 0.300, 0.325, 0.350, 0.375, 0.400, 0.425, 0.450, 0.475, or 0.500 inch.

MCM Panel 326 Weight

Incorporating the MCM material 326 in place of all-metal constructions of components of a golf club head provides the required durability and rigidity while saving overall mass since the weight of the MCM portion 326 would be lighter than an all-metal construction of the embodiments. The cross-sectional area, thickness of the layers, and utilized materials for each layer impact the overall weight and weight savings capabilities of the MCM constructed embodiment. The following weight savings ranges account for constructions that utilize titanium (Ti), titanium alloy (e.g. Ti-6-4, Ti-8-1-1, T-9S, or BE α-β Ti alloy), aluminum (Al), aluminum alloy, steel, steel alloy, tin, tin alloy, or any other suitable metal. In some embodiments, the weight savings of the MCM construction 326 versus the all-metal construction can be between 3% and 50%. In other embodiments, the weight savings of the MCM construction 326 versus the all-metal construction can be up to 70%. In some embodiments, the MCM construction 326 can be up to 3%, 5%, 10%, 12%, 14%, 16%, 18%, 20%, 22%, 24%, 26%, 28%, 30%, 32%, 34%, 36%, 38%, 40%, 42%, 44%, 46%, 48%, or up to 50% lighter than an all-metal construction. In some embodiments, the MCM construction 326 can be at least 3%, 5%, 10%, 12%, 14%, 16%, 18%, 20%, 22%, 24%, 26%, 28%, 30%, 32%, 34%, 36%, 38%, 40%, 42%, 44%, 46%, 48%, or at least 50% lighter than an all-metal construction. In some embodiments, the MCM construction 326 can be greater than or equal to 3%, 5%, 10%, 12%, 14%, 16%, 18%, 20%, 22%, 24%, 26%, 28%, 30%, 32%, 34%, 36%, 38%, 40%, 42%, 44%, 46%, 48%, or greater than or equal to 50% lighter than an all-metal construction. In some embodiments, the MCM construction 326 can be at less than or equal to 3%, 5%, 10%, 12%, 14%, 16%, 18%, 20%, 22%, 24%, 26%, 28%, 30%, 32%, 34%, 36%, 38%, 40%, 42%, 44%, 46%, 48%, 50%, 52%, 54%, 56%, 58%, 60%, 62%, 64%, 66%, 68%, or less than or equal to 70% lighter than an all-metal construction. For example, the MCM construction 326 can be 3%, 5%, 10%, 12%, 14%, 16%, 18%, 20%, 22%, 24%, 26%, 28%, 30%, 32%, 34%, 36%, 38%, 40%, 42%, 44%, 46%, 48%, or 50% lighter than an all-metal construction.

Incorporating the MCM construction 326 into one or more components of a golf club head can make the club head up to 20% lighter when compared to a golf club head having the same or similar construction, but with all-metal components in place of the MCM components 326. In some embodiments, the golf club head with at least one MCM component can be up to 1%, 2%, 3%, 4%, 5%, 6%, 8%, 10%, 12%, 14%, 16%, 18%, or up to 20% lighter than the stock build golf club head. In some embodiments, the golf club head with at least one MCM component can be at least 1%, 2%, 3%, 4%, 5%, 6%, 8%, 10%, 12%, 14%, 16%, 18%, or at least 20% lighter than the standard build golf club head. In some embodiments, the golf club head with at least one MCM component can be greater than or equal to 1%, 2%, 3%, 4%, 5%, 6%, 8%, 10%, 12%, 14%, 16%, 18%, or greater than or equal to 20% lighter than the stock build golf club head. In some embodiments, the golf club head with at least one MCM component can be less than or equal to 1%, 2%, 3%, 4%, 5%, 6%, 8%, 10%, 12%, 14%, 16%, 18%, or less than or equal to 20% lighter than the standard build golf club head. For example, the golf club head with at least one MCM component can be 1%, 2%, 3%, 4%, 5%, 6%, 8%, 10%, 12%, 14%, 16%, 18%, or 20% lighter than the standard build golf club head. The weight savings described above are applicable when comparing the club head comprising MCM components with an identical club head comprising all-metal components in place of the MCM components. In some embodiments, the remaining portions of the golf club head can be made of all metal. In other embodiments, the remaining portions of the golf club head can be made of a combination of metal and composite.

The weight savings can be dependent on the thickness of each layer, the material used for each layer, and the cross-sectional surface area of the MCM portion 326. For example, a MCM construction 326 with 0.05 inch thick metal layers formed of titanium and a 0.05 inch thick composite layer formed of PEEK is 23.7% lighter than an all-titanium construction. Keeping the cross-sectional area and the layer thicknesses the same as the previously described example but replacing the PEEK composite material with PPS, the weight savings of the MCM construction over an all-titanium construction is 23.4%. Another example utilizing the titanium-PEEK-titanium MCM material construction but replacing the metal layers with metal layers 0.025 inch thick produces a construction that is 35.6% lighter than the all-titanium construction. Thus, manipulating the layer material compositions for different embodiments can produce varying weight savings opportunities while optimizing the mechanical characteristics of the MCM portion 326.

MCM Panel 326 Shapes

The MCM portion 326 can take on any shape that would typically be casted or forged to form the desired structure. In some embodiments, the MCM portion 326 can be formed into a two-dimensional polygonal shape that may or may not comprise a slight curvature. The MCM portion 326 can be in shapes that resemble the following 2-D shapes: rectangular, triangular, hexagonal, honeycomb, circular, rhombus, square, or any other suitable shape. In other embodiments, the MCM portion 326 can be formed into complex three-dimensional shapes comprising one or more curved or bent regions, and/or variable thickness regions. In some embodiments, the MCM construction 326 can be in the shape of a faceplate 402, a weight support structure, a slit or channel, ribs or any other structure in the golf club head that requires strength, but benefits from the weight savings of the MCM construction 326.

MCM Panel 326 Mechanical Properties

The durability of the MCM portion 326 can vary depending on its application. The use of multi-directional oriented fibers can improve the durability of different components of the club head. In some embodiments, the MCM portion 326 can withstand a total number of hits in an air cannon before failure between 900 hits and 2300 hits. In some embodiments, the MCM portion 326 can withstand up to 900 hits, 950 hits, 1000 hits, 1050 hits, 1100 hits, 1150 hit, 1200 hits, 1250 hit, 1300 hits, 1350 hit, 1400 hits, 1450 hit, 1500 hits, 1550 hit, 1600 hits, 1650 hit, 1700 hits, 1750 hit, 1800 hits, 1850 hit, 1900 hits, 1950 hit, 2000 hits, 2050 hit, 2100 hits, 2150 hit, 2200 hits, 2250 hit, or up to 2300 hits. In some embodiments, the MCM portion 326 can withstand at least 900 hits, 950 hits, 1000 hits, 1050 hits, 1100 hits, 1150 hit, 1200 hits, 1250 hit, 1300 hits, 1350 hit, 1400 hits, 1450 hit, 1500 hits, 1550 hit, 1600 hits, 1650 hit, 1700 hits, 1750 hit, 1800 hits, 1850 hit, 1900 hits, 1950 hit, 2000 hits, 2050 hit, 2100 hits, 2150 hit, 2200 hits, 2250 hit, or at least 2300 hits. In some embodiments the MCM portion 326 can withstand up to 10%, 20%, 30%, 40%, 50%, 60%, 70%, 80%, 90%, 100%, 110%, or up to 120% more hits than stock metal. In some embodiments the MCM portion 326 can withstand at least 10%, 20%, 30%, 40%, 50%, 60%, 70%, 80%, 90%, 100%, 110%, or at least 120% more hits than stock metal. In one example, a MCM panel 326 comprised of titanium (Ti 6-4) and PEI withstood 2150 hits in air cannon testing, which is 115% more hits than the stock titanium sample withstood in the air cannon.

The flexural modulus of the MCM portion 326 can vary depending on its application, material characteristics and material properties as the flexural modulus will be affected by the orientation and distribution of the composite fibers. A benefit of the MCM panel 326 is that it can be easily manipulated to produce desired flexural modulus values. For example, the composite layer's 332 material composition and thickness can be adjusted with the metal layers (330, 334) to produce a panel 326 that has a comparable flexural modulus as titanium, steel, or any other suitable metal. In some embodiments, the flexural modulus of the MCM sandwich 326 can be between 14000 ksi and 27000 ksi. In some embodiments the flexural modulus of the MCM sandwich 326 can be between 14000 and 15000, 15000 and 16000, 16000 and 17000, 17000 and 18000, 18000 and 19000, 19000 and 20000, 20000 and 21000, 21000 and 22000, 22000 and 23000, 23000 and 24000, 24000 and 25000, 25000 and 26000, or between 26000 and 27000 ksi. In some embodiments the flexural modulus of the MCM sandwich 326 can be up to 14000, 15000, 16000, 17000, 18000, 19000, 20000, 21000, 22000, 23000, 24000, 25000, 26000, or up to 27000 ksi. In some embodiments the flexural modulus of the MCM sandwich 326 can be at least 14000, 15000, 16000, 17000, 18000, 19000, 20000, 21000, 22000, 23000, 24000, 25000, 26000, or at least 27000 ksi. In some embodiments the flexural modulus of the MCM sandwich 326 can be greater than or equal to 14000, 15000, 16000, 17000, 18000, 19000, 20000, 21000, 22000, 23000, 24000, 25000, 26000, or greater than or equal to 27000 ksi. In some embodiments the flexural modulus of the MCM sandwich 326 can be less than or equal to 14000, 15000, 16000, 17000, 18000, 19000, 20000, 21000, 22000, 23000, 24000, 25000, 26000, or less than or equal to 27000 ksi. In one example, the MCM sandwich 326 has a flexural modulus of 16072 ksi. In another example, the MCM sandwich 326 has a flexural modulus of 15239 ksi.

In some embodiments, Young's Modulus of the MCM sandwich 326 may be between 14 Mpsi and 20 Mpsi, 14.0 Mpsi and 14.25 Mpsi, 14.25 Mpsi and 14.5 Mpsi, 14.5 Mpsi and 14.75 Mpsi, 14.75 Mpsi and 15.0 Mpsi 15.0 Mpsi and 15.25 Mpsi, 15.25 Mpsi and 15.5 Mpsi, 15.5 Mpsi and 15.75 Mpsi, 15.75 Mpsi and 16.0 Mpsi, 16.0 Mpsi and 16.25 Mpsi, 16.25 Mpsi and 16.5 Mpsi, 16.5 Mpsi and 16.75 Mpsi, 16.75 Mpsi and 17.0 Mpsi, 18.0 Mpsi and 18.25 Mpsi, 18.25 Mpsi and 18.5 Mpsi, 18.5 Mpsi and 18.75 Mpsi, 18.75 Mpsi and 18.0 Mpsi, 19.0 Mpsi and 19.25 Mpsi, 19.25 Mpsi and 19.5 Mpsi, 19.5 Mpsi and 19.75 Mpsi, and 19.75 Mpsi and 20.0 Mpsi.

Golf Club Head

The MCM panel 326, as described above, can be manufactured into any of multiple components of the golf club head. For example, but not limited to, the MCM composition 326 can be manufactured into a faceplate 402, a face cup 436, a weight channel or weight channel support structure 560, a channel, or a rib 550. These compositions can then be oriented in the golf club head so as to provide the desired weight savings, while maintaining the strength, durability, and flexibility required and tailored for the particular design and physical goals of the golf club head.

Referring to FIGS. 1, 4, 6, 7, 8, 10, and 11, the golf club head body having the faceplate 402, ribs, and/or weight channel described below is a driver-type golf club head. In other embodiments, the golf club head body 162 can be any wood-type golf club head (i.e. a driver, a fairway wood, or a hybrid), iron-type golf club head 700, or putter-type golf club head 800.

Characteristics of Wood-Type Clubs

The wood-type golf club head assembly can comprise a club head body 162 and a faceplate 102. Golf club head components sharing similar features are indicated by like reference numbers spaced by a value of 100 (e.g. a golf club head faceplate can be described by reference numbers 102, 202, 302, etc.). Many features described with reference to '100' numbers (e.g. 102, 104, 106, etc.) can be applied to like reference numbers. The details described below in reference to golf club head body 162 including a faceplate (102, 402) can also be applied to golf club head body 962 including a face cup 902, unless otherwise specified. The wood-type golf club head body 162 can further comprise a front end 112, a rear 110, a heel end 108, a toe end 106 opposite the heel end 108, a crown 104, a sole 114 opposite the crown 104, a leading edge 116, and a hosel 118.

In some embodiments, golf club 100 can include: (a) a golf club head 100; (b) a shaft (not shown); and (c) a hosel 118 coupled to the shaft. In a different embodiment, the golf club has a hole, instead of hosel 118, to which the shaft is coupled. A first end of the shaft and hosel 118 may be secured to each other by an adhesive bonding process (e.g., epoxy) and/or other suitable bonding processes (e.g., mechanical bonding, soldering, welding, and/or brazing). To complete the golf club, a grip (not shown) may receive a second or opposite end of the shaft. The shaft and the grip may be secured to each other by an adhesive bonding process and/or other suitable bonding processes. In some examples, hosel 118 or the hole can be at the heel end of golf club head 100 or at a center of golf club head 100.

Golf club head 100 can include: (a) a club face 102 (i.e., a strike face) to engage a golf ball, (b) a sole 114 coupled to club face 102; (c) a toe 106 coupled to club face 102 and sole 114; (d) a heel end 108 opposite toe end 106 and coupled to club face 102 and sole 114; and (e) a top surface (e.g., a crown 104, or a top rail 704) coupled to club face 102, toe end 106, and heel end 108.

In some examples, golf club head 100 can be manufactured from a steel material, another metal, or one or more other materials by a casting process, a forging process, a combination thereof, or one or more other suitable manufacturing processes. In many examples, golf club head 100 can be formed as a unitary body. In other examples, golf club head 100 can be made of multiple pieces (e.g., a separate faceplate 402 and/or separate inserts to form the grooves, a crown insert, or other components, such as turbulators 442, ribs 550, a support structure 446, or a weight structure 560 that can be separately attached).

MCM Constructed Faceplate 402

An embodiment is using the MCM composition 326 in a golf club head's faceplate 402. The faceplate 402 must be durable enough to withstand repetitive impacts while retaining mechanical characteristics that optimize club head performance (ie. light weight, CT, CG). For example, utilizing a dense metal for the faceplate 402 can shift the CG of the club closer to the face, which can negatively affect golf ball spin and launch characteristics. Thus, creating a faceplate 402 out of the MCM material 326 can reduce weight at the front of the club head while maintaining strength and durability due to the composite layer's fiber orientation characteristics.

The details described below in reference to golf club head body including a faceplate 102 can also be applied to golf club head body 402 including a face cup 436, unless otherwise specified. In one embodiment, the golf club head body 102 is formed from a cast material, or a combination of a cast material and a weight saving material.

Referring to FIG. 1, the faceplate 102 includes a heel end and a toe end, opposite the heel end. The heel end is positioned proximate the hosel portion (hosel and hosel transition) where the shaft is coupled to the club head assembly. The faceplate 402 further includes a crown edge and a sole 114 edge opposite the crown edge. The crown edge is positioned adjacent an upper edge of the club head body, while the sole 114 edge is positioned adjacent the lower edge of the club head body. The faceplate 102 can have a bulge curvature in a direction extending between the heel end and the toe end. The faceplate 102 can have a roll curvature in a direction extending between the crown and the sole 114.

Figure 19:
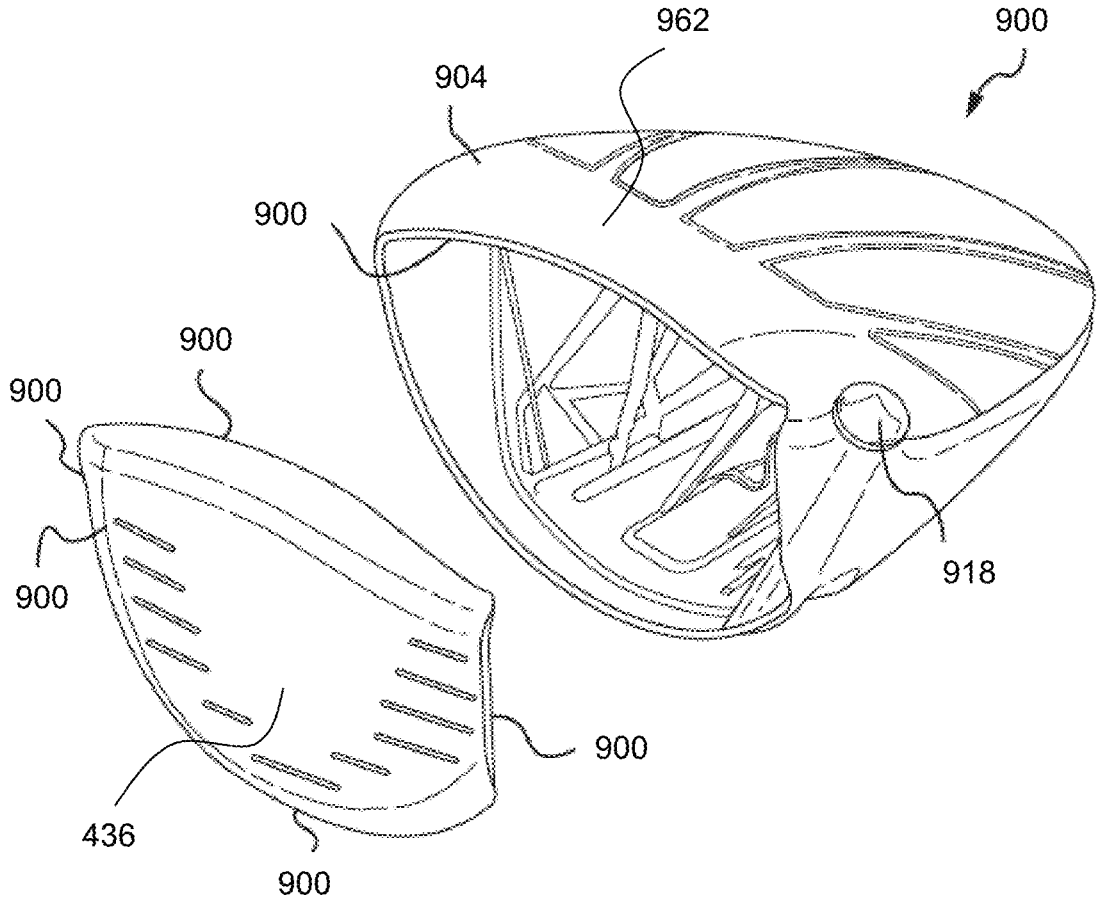
FIG. 19 illustrates an exploded perspective view of a wood-type golf club head comprising a face cup, according to one embodiment.

In some embodiments, the faceplate 402 can be a face cup 436. The face cup 436 of golf club head body 400, illustrated in FIG. 19, is similar in many ways to the faceplate 402, described above. As shown in FIG. 19, the club head body 462 further defines a recess or opening 436 for receiving the face cup 436. In the illustrated embodiment, the opening 436 includes a lip 449 extending around the perimeter of the opening 436. The face cup 436 is aligned with the opening 436 and abuts the lip 449. The face cup 436 is secured to the body 462 by welding, forming a club head assembly 400. The face cup 436 can be secured to the body 462 via a pulse plasma welding process, continuous laser welding, or any other suitable welding process.

The face cup 436 comprises a toe portion 406, a heel portion 408, a crown edge and a sole edge opposite the crown edge. The face cup 436 is configured to be received within and permanently affixed to an aperture 436 in the body to form a front portion of the golf cub head 400. The crown return 438, sole return 440, and toe portion 406 surround the face cup strike face portion 436. The crown edge defines a portion of a peripheral edge 448 along the crown return 438. The sole edge defines a portion of a peripheral edge 448 along the sole return 440. The crown edge is positioned adjacent an upper edge of the club head body 462, while the sole edge is positioned adjacent a lower edge of the club head body 462. The face cup 436 crown edge and sole 114 edge are configured to abut the lip 449 of the aperture 436. Alternate embodiments can include a version of the face cup 436 comprising a sole 114 return 440 while lacking a crown return 438, or comprising a crown return 438 while lacking a sole 114 return 440. Further embodiments can include a version of the face cup 436 comprising only a portion of the sole 114 return 440 (not extending along the entire width of the sole 114 in a heel to toe direction), and/or only a portion of the crown return 438 (not extending along the entire width of the crown in a heel to toe direction).

Figure 3E:
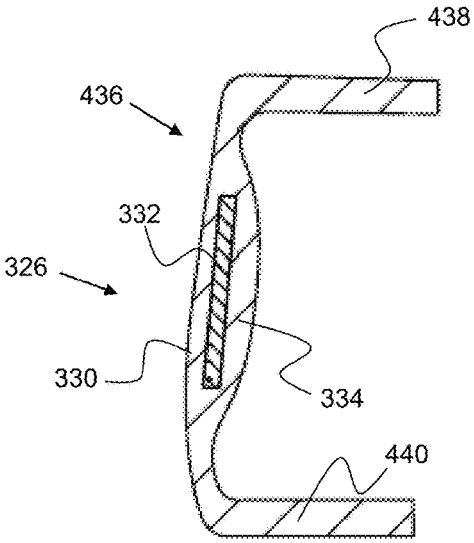
FIG. 3E illustrates a cross-section view of a MCM panel, according to a fifth embodiment.
Figure 4:
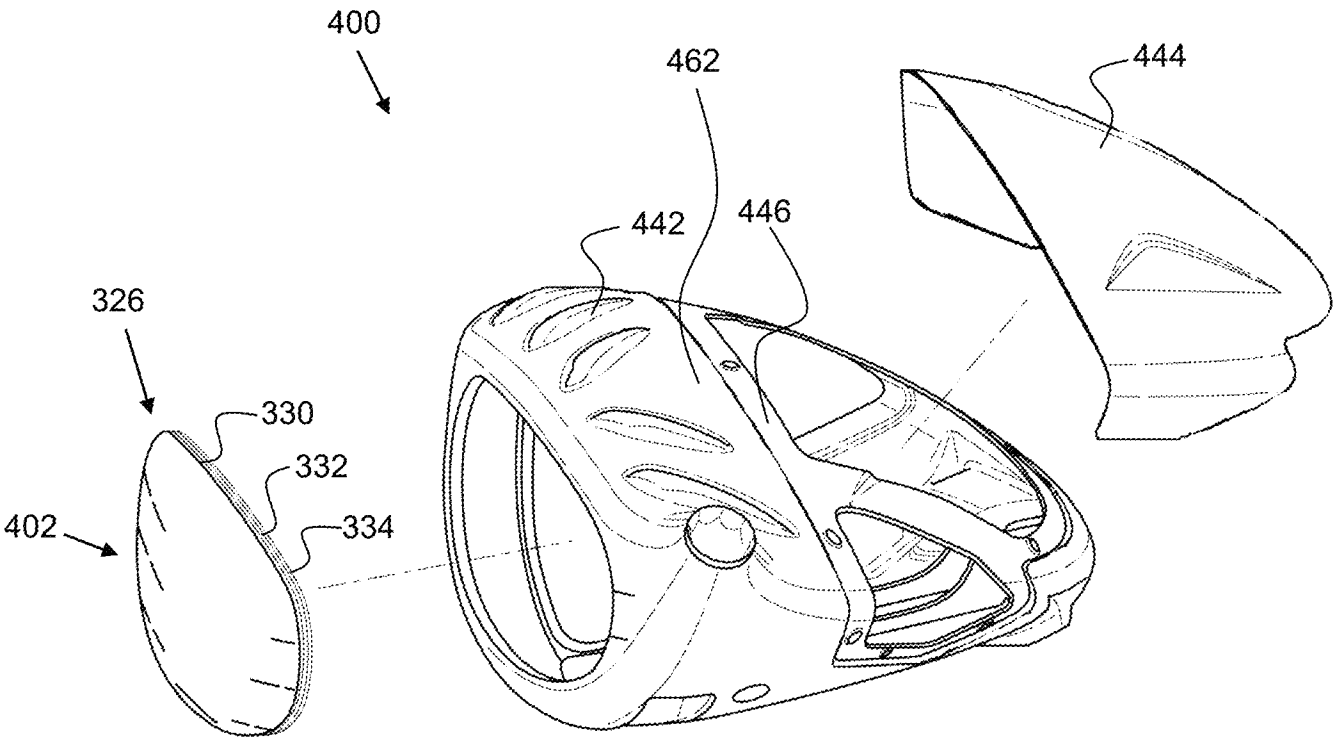
FIG. 4 illustrates an exploded perspective view of a wood-type golf club head body, a crown insert, and a faceplate, according to a second embodiment.
Figure 5A:
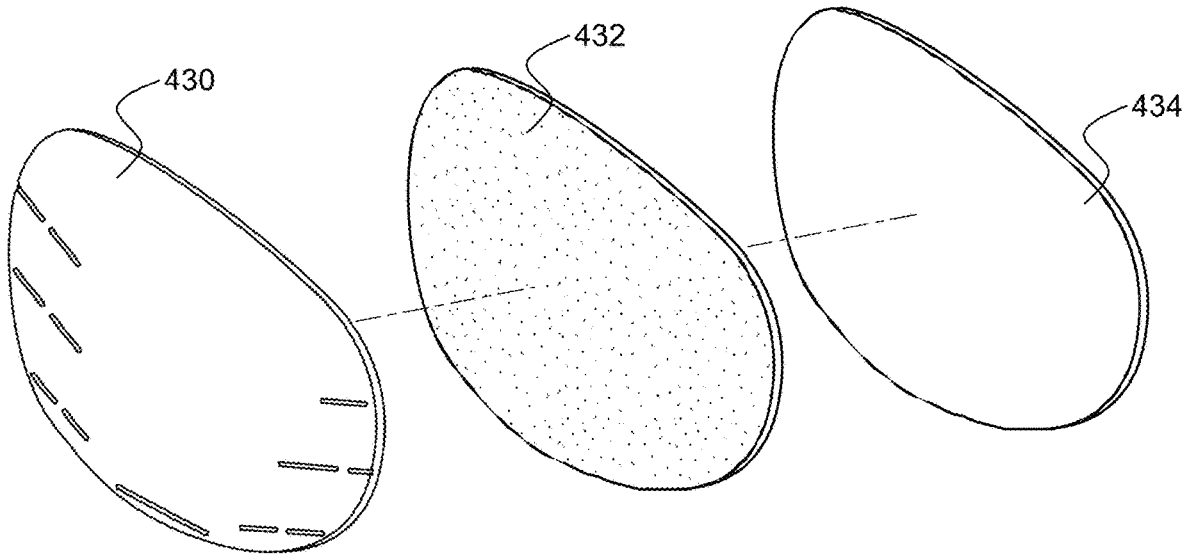
FIG. 5A illustrates an exploded view of the MCM construction face plate of the golf club head of FIG. 4.
Figure 5B:
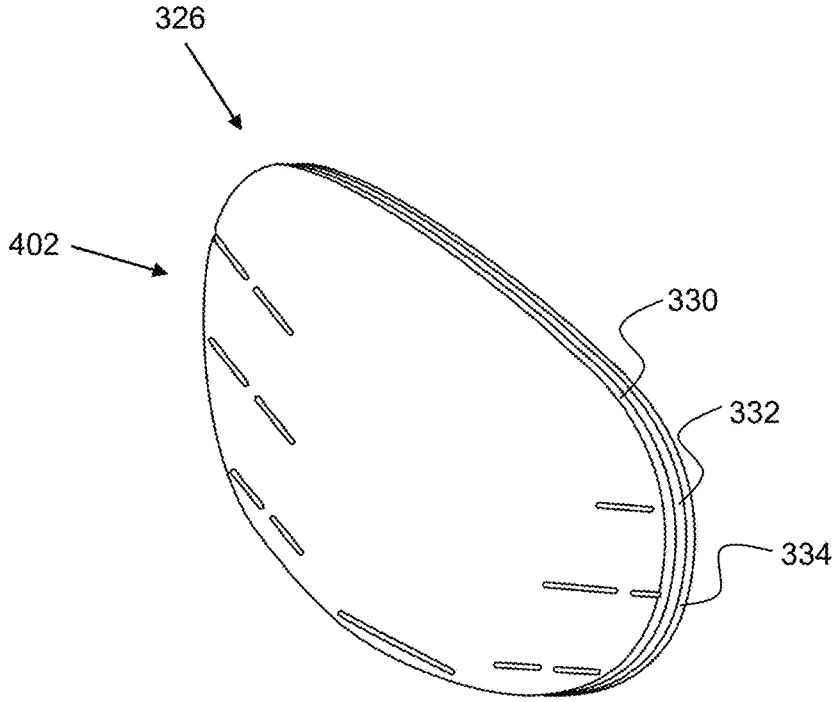
FIG. 5B illustrates a perspective view of the face plate of the golf club head of FIG. 4.
Figure 6A:
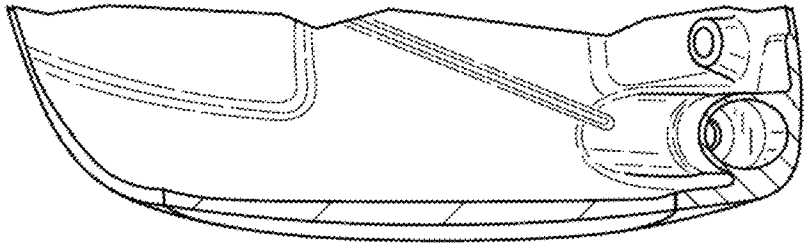
FIG. 6A illustrates a top-down cross-section view of the front region of a golf club head with a traditional face plate having variable thickness, according to one embodiment.
Figure 6B:
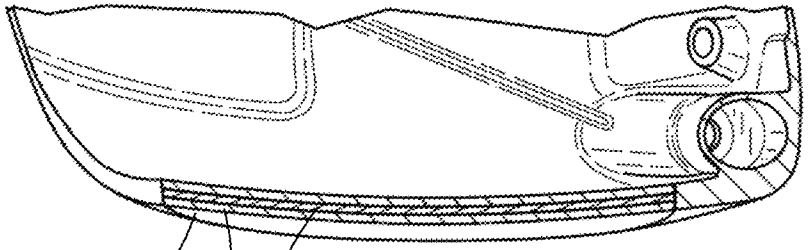
FIG. 6B illustrates a top-down cross-section view of the front region of a golf club head comprising a MCM construction face plate, according to a fourth embodiment.
Figure 6C:
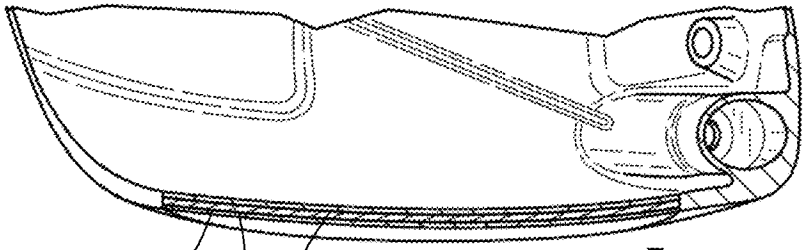
FIG. 6C illustrates a top-down cross-section view of the front region of a golf club head comprising a MCM construction face plate, according to a fifth embodiment.
Figure 6D:
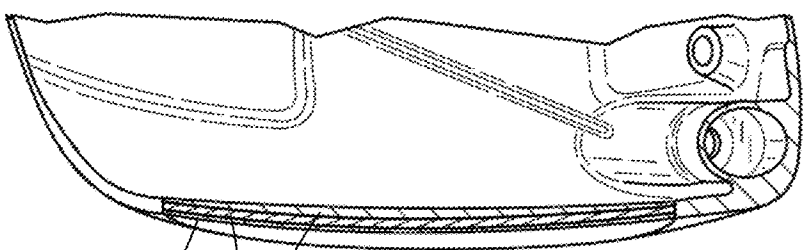
FIG. 6D illustrates a top-down cross-section view of the front region of a golf club head comprising a MCM construction face plate, according to a sixth embodiment.
Figure 7D:
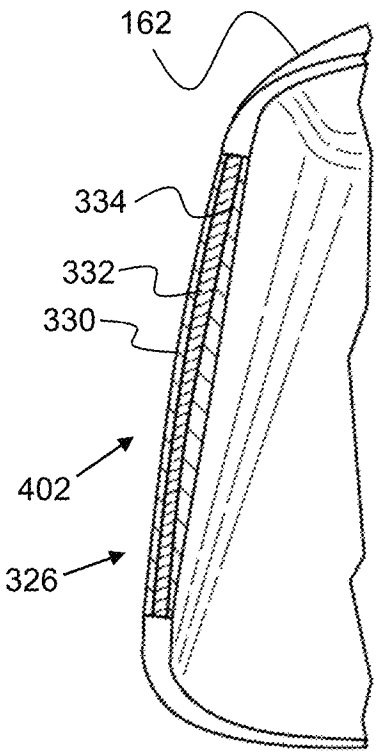
FIG. 7D illustrates a cross-sectional side view of the front region of a golf club head comprising the face plate of FIG. 6D.
Figure 7C:
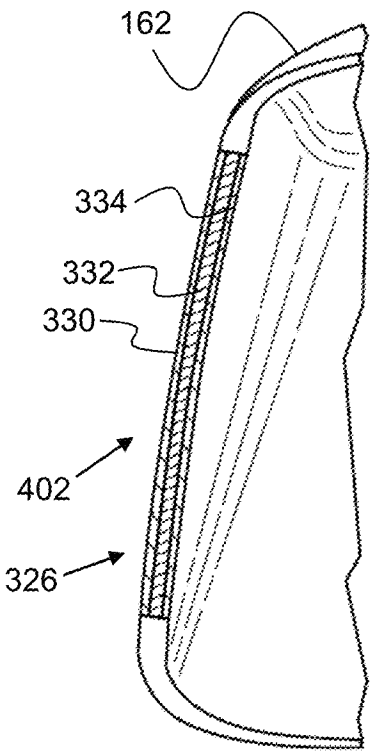
FIG. 7C illustrates a cross-sectional side view of the front region of a golf club head comprising the face plate of FIG. 6C.
Figure 7B:
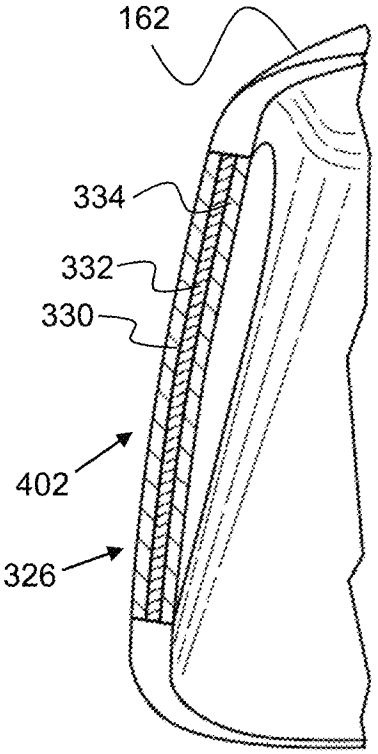
FIG. 7B illustrates a cross-sectional side view of the front region of a golf club head comprising the face plate of FIG. 6B.
Figure 7A:
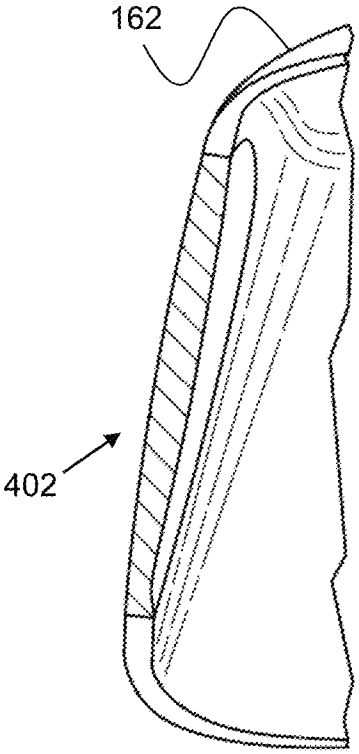
FIG. 7A illustrates a cross-sectional side view of a golf club head comprising the face plate of FIG. 6A.
Figure 8:
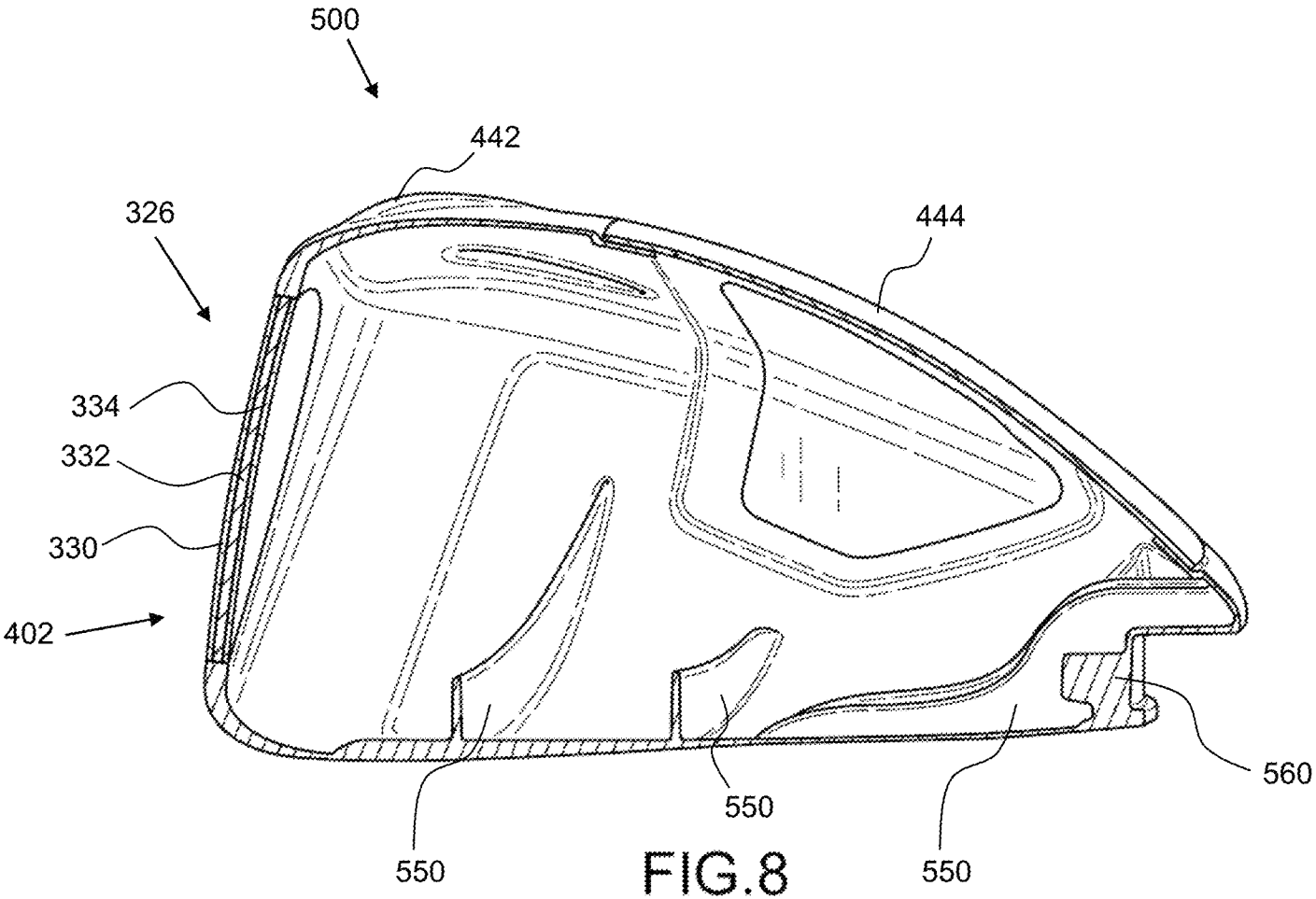
FIG. 8 illustrates a cross-sectional side view of a golf club head comprising a MCM faceplate, a crown insert, internal ribs, and a weight port, according to a seventh embodiment.
Figure 9A:
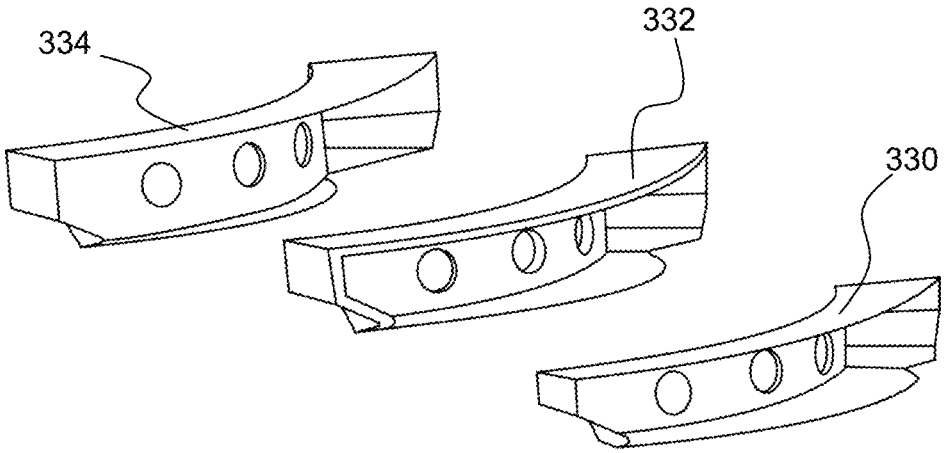
FIG. 9A illustrates an exploded view of a MCM construction weight port, according to a first embodiment.
Figure 9B:
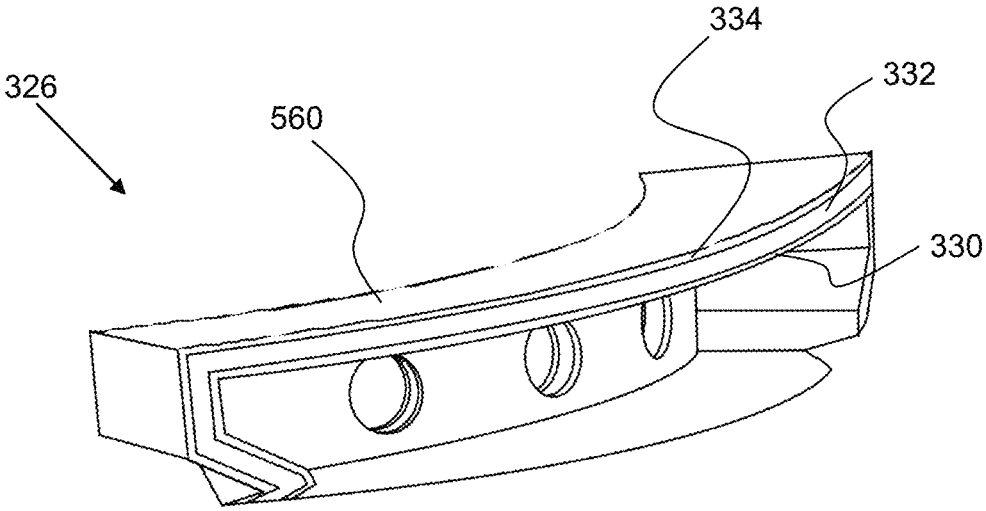
FIG. 9B illustrates a perspective view of the MCM construction weight port of FIG. 9A.
Figure 10:
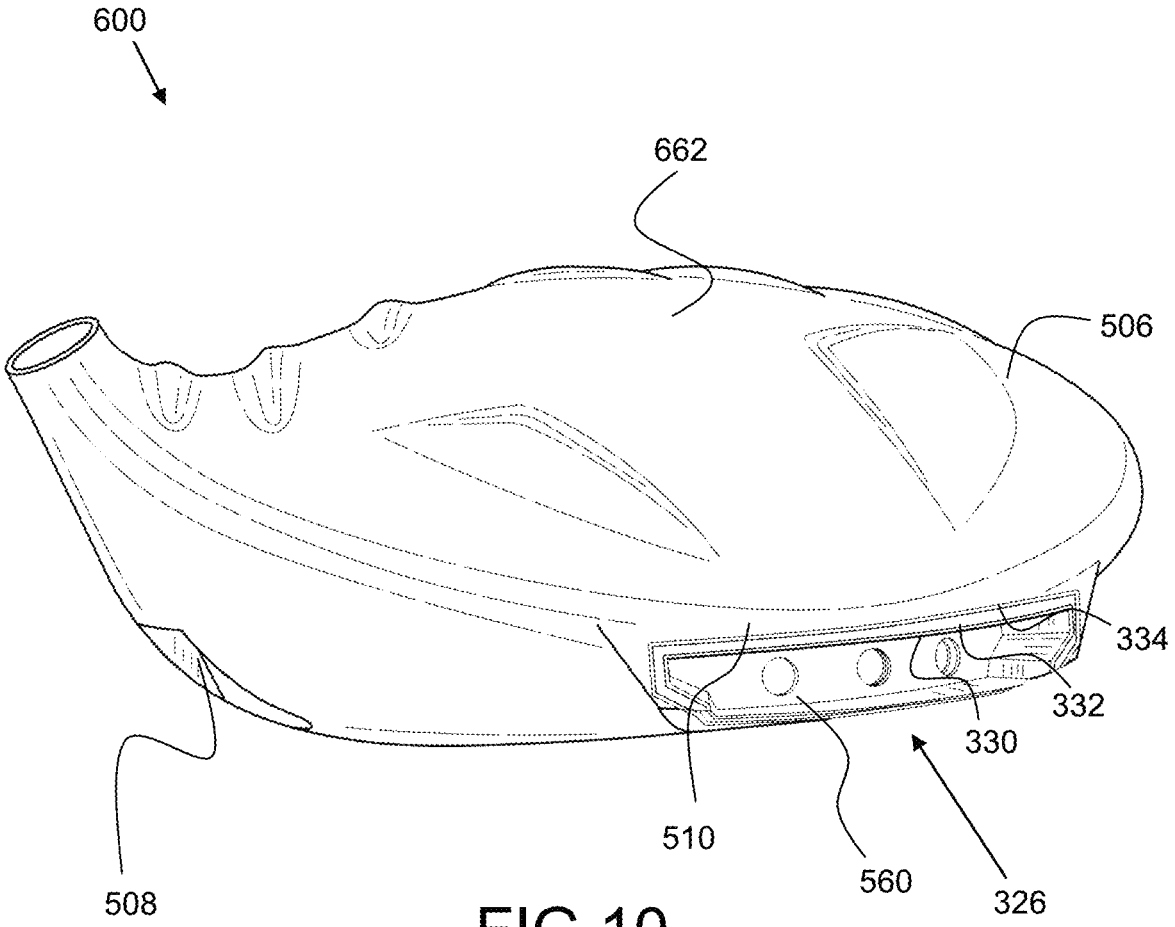
FIG. 10 illustrates a rear perspective view of the a golf club head comprising a MCM construction weight port, according to an eighth embodiment.
Figure 11:
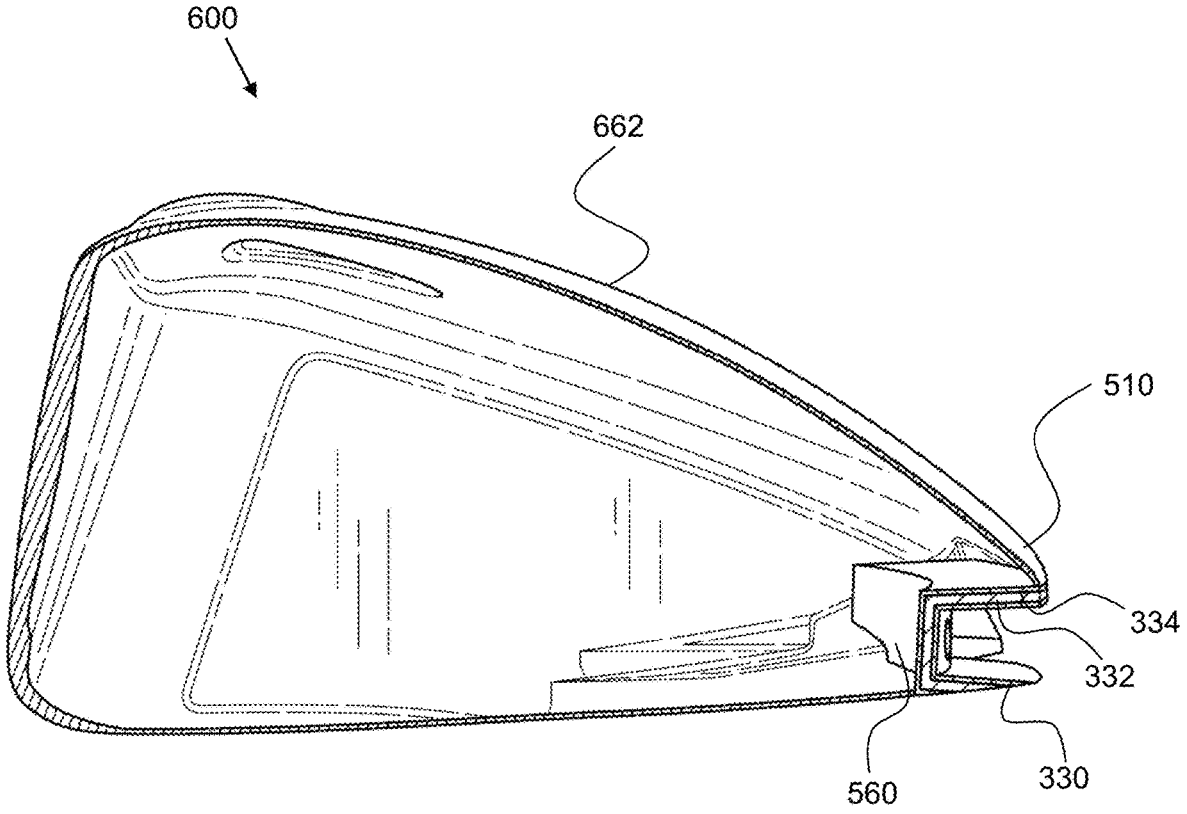
FIG. 11 illustrates a cross-sectional side view of the golf club head of FIG. 10.

In many embodiments comprising a face cup 436, the dimensions and geometry of the composite layer 332 can be the same as that of a faceplate 402. Referring to FIG. 3E, in some of these embodiments, the crown return 438 and sole return 440 comprise metal and are devoid of a composite layer 332. In other embodiments, the composite layer 332 can extend to the crown return 438 and the sole return 440 portions. In some of these embodiments, the second layer 332 can extend to the ends of the face cup 436. In other embodiments, the composite layer 332 can extend into a portion of the crown return 438 and/or a portion of the sole return 440, but not all the way to the edges.

In some embodiments, the minimum and maximum wall thicknesses of the faceplate 402 or face cup 436 comprising the MCM sandwich 326 described herein can be between 0.075 and 0.150 inch. In some embodiments, the wall thickness can be up to 0.075, 0.080, 0.085, 0.090, 0.095, 0.100, 0.105, 0.110, 0.115, 0.120, 0.125, 0.130, 0.135, 0.140, 0.145, or up to 0.150 inch. In some embodiments, the wall thickness can be at least 0.075, 0.080, 0.085, 0.090, 0.095, 0.100, 0.105, 0.110, 0.115, 0.120, 0.125, 0.130, 0.135, 0.140, 0.145, or at least 0.150 inch. The thickness of the MCM material 326 can be uniform across the faceplate 402 or face cup 436 or it can vary. For example, the thickness at the perimeter of a faceplate 402 can be 0.084 inch and 0.134 inch at the center of the faceplate 402.

In some embodiments, the minimum and maximum mass of the faceplate 402 comprising the MCM sandwich 326 described herein can be between 3% to 40% lighter than that of a faceplate 402 comprising a stock metal composition. In some embodiments, the MCM faceplate 402 can be up to 3%, up to 5%, up to 8%, up to 10%, up to 15%, up to 20%, up to 25%, up to 30%, up to 35%, or up to 40% lighter than a stock metal faceplate 402. In some embodiments, the MCM faceplate 402 can be at least 3%, 5%, 8%, 10%, 15%, 20 25%, 30%, 35%, or at least 40% lighter than a stock metal faceplate 402.

In one example, a faceplate 402 construction that has a titanium-PEEK-titanium composition with a first layer 330 thickness of 0.05 inch, a second layer 332 thickness of 0.05 inch, and a third layer 334 thickness of 0.05 inch is 23.7% lighter than an all-titanium construction. In another example, a faceplate 402 construction that has a titanium-PEEK-titanium composition with a first layer 330 thickness of 0.025 inch, a second layer 332 thickness of 0.05 inch, and a third layer 334 thickness of 0.025 inch is 35.6% lighter than an all-titanium construction. In another example, a faceplate 402 construction that has a titanium-PEEK-titanium composition with a first layer 330 thickness of 0.025 inch, a second layer 332 thickness of 0.05 inch, and a varying third layer 334 thickness between 0.025 inch and 0.059 inch is 31.4% lighter than an all-titanium construction. In another example, a faceplate 402 construction that has a titanium-PPS-titanium composition with a first layer 330 thickness of 0.05 inch, a second layer 332 thickness of 0.05 inch, and a third layer 334 thickness of 0.05 inch is 23.4% lighter than an all-titanium construction. In another example, a faceplate 402 construction that has a titanium-PEEK-titanium composition with a first layer 330 thickness of 0.025 in, a second layer 332 thickness of 0.05 inch, and a third layer 334 thickness of 0.025 inch is 33.5% lighter than an all-titanium construction. In another example, a faceplate 402 construction that has a titanium-PEEK-titanium composition with a first layer 330 thickness of 0.025 inch, a second layer 332 thickness of 0.05 inch, and a varying third layer 334 thickness between 0.025 inch and 0.059 inch is 31.0% lighter than an all-titanium construction.

In some embodiments, the faceplate 402 can comprise a buffer zone 328. The buffer zone 328 can consist of only the metal material(s) and be devoid of the composite material. The buffer zone 328 can allow the face to be fastened into the club head body via a method that could cause damage to the central layer. In embodiments comprising a buffer zone 328, the second layer 332 can be completely enclosed within the first layer 330 and third layer 334. In these embodiments, the second layer 332 can comprise a smaller heel-to-toe length and a smaller top-to-bottom height than that of the first and third layer 334*s*.

In embodiments comprising a buffer zone 328, near the perimeter of the face, one or both of the first and third layer 334*s* can be bent toward the other, such that the first and third layer 334*s* lay substantially flat against one another. The buffer zone 328, in which the first layer 330 and the third layer 334 abut one another, can be beyond a perimeter of the second layer 332. In other words, the second layer 332 terminates at the edge of the buffer zone 328, such that it does not extend into the buffer zone 328. This creates a buffer zone 328, lacking the central material, having a width that is measured between the perimeter edge of the face and the perimeter edge of the central layer. The buffer zone 328 width can be consistent along the entire perimeter and can be between 0.35 inch and 1.5 inches. In some embodiments, the buffer zone 328 can be less than 0.40 inch, 0.50 inch, 0.60 inch, 0.70 inch, 0.80 inch, 0.90 inch, 1.0 inch, 1.1 inches, 1.2 inches, 1.3 inches, 1.4 inches, or 1.5 inches. In one example, the buffer zone 328 width can be 0.75 inch. The outer edges of the external and internal layers can be joined together via welding prior to installing the face onto the club head body. The face can then be fastened to the body via welding or another suitable method. In many embodiments, all welding related to the face can be in the form of laser welding.

In other embodiments, the faceplate 402 does not comprise a buffer zone 328. In these embodiments, the first layer 330, second layer 332 and third layer 334 all terminate along the same plane around some or all edges of the faceplate 402.

MCM Constructed Ribs

Another embodiment for the MCM construction 326 is within golf club head ribs 550. Ribs 550 provide support for thin regions of the club head (e.g. crown, faceplate 402), for stress and impact deflection, or for sound control. The addition of ribs 550 for these applications, however, can add mass to certain locations of a club head which can shift CG and negatively impact spin and launch characteristics. Ribs 550 constructed of the MCM construction 326 provide the strength and sound control capabilities but are up to 25% lighter than traditional Ti constructed ribs 550.

The club head can comprise ribs 550 secured across all club head components (i.e. metal body, composite shell, and rear 110 body). The ribs 550 must be formed from a strong, durable material to provide structural rigidity to each club head component. The internal ribs 550 can reduce unwanted vibration at the mass portion, which is desirable because so much of the mass of the golf club head is located so far to the rear 110 of the golf club head. Reducing the weight of the rib 550 component with the MCM sandwich panel 326 would allow for the weight to be redistributed to specified locations of the golf club head while providing the strong material properties required for the ribs 550.

The ribs 550 can be structured and positioned within the golf club head as described in U.S. patent application Ser.

No. 15/076,511, which is fully incorporated herein by reference. In some embodiments, the interior of the golf club can comprise a plurality of internal ribs 550 having an internal rib 550 width. The plurality of internal ribs 550 may comprise two ribs 550, three ribs 550, four ribs 550, five ribs 550, or more than five ribs 550. The ribs 550 are secured within the closed interior volume of the club head, more particularly, secured on an interior surface of the sole 114. In other embodiments, the ribs 550 can be secured on an interior surface of the crown, or a combination of the interior surface of the sole 114 and crown. The internal ribs 550 further comprise a rib 550 height and a rib 550 length.

The internal rib 550 width can range from 0.025 inch to 0.100 inch. For example, the internal rib 550 width may be 0.025, 0.050, 0.075, or 0.100 inch. The internal rib 550 length can range from 0.100 to 1.500 inch. For example, the internal rib 550 length may be 0.100, 0.200, 0.300, 0.400, 0.500, 0.600, 0.700, 0.800, 0.900, 1.000, 1.100, 1.200, 1.300, 1.400, or 1.500 inches.

The weight savings of MCM constructed ribs 550 over stock metal ribs 550 can be up to 25% per rib. The weight savings varies on utilized layer materials and dimensions. In some embodiments, the MCM rib 550 can be up to 1%, up to 2%, up to 3%, up to 4%, up to 5%, up to 8%, up to 10%, up to 12%, up to 15%, up to 17%, up to 20%, up to 22%, or up to 25% lighter than a stock metal rib. In some embodiments, the MCM rib 550 can be at least 1%, 2%, 3%, 4%, 5%, 8%, 10%, 12%, 15%, 17%, 20%, 22%, or at least 25% lighter than a stock metal rib.

MCM Constructed Weight Channel Support

A golf club head having an adjustable weight system allows users to adjust the club head's center of gravity to influence ball flight characteristics (i.e. ball spin or trajectory) to optimize performance. The support structure of this weight system's channel is thick when compared to other regions of the golf club head, thus contributes significantly to the structural mass of the club head. Having a lighter weight channel support structure 560 would make the attachable weight for the weight channel more impactful and influential on the club head. Weight channel support 560 constructed of the MCM construction 326 provide the strength and support capabilities but are up to 45% lighter than traditional metal constructed support structures.

The weight channel can be structured and positioned within the golf club head as described in U.S. patent application Ser. No. 16/185,923, which is fully incorporated herein by reference. In some embodiments, the golf club head includes an adjustable weighting system that is positioned on the body, the adjustable weighting system 560 includes a single channel and a plurality of attachment positions within the single channel, wherein each of the plurality of attachment positions are configured to receive a weight. The channel is positioned at a club head periphery, more specifically at the rear 110 of the club positioned on the sole 114, adjacent to the crown. Further, the channel runs along the heel end to the toe end of the club head, wherein both ends of the channel is equidistant from the strike face of the club head. Further still, the channel of the club head comprises a side wall and a floor wall.

The weight savings of MCM constructed weight channel support over stock metal weight channel support can be up to 45%. The weight savings varies on utilized layer materials and dimensions. In some embodiments, the MCM weight channel support can be up to 5%, up to 10%, up to 15%, up to 20%, up to 25%, up to 30%, up to 35%, up to 40%, or up to 45% lighter than all-metal constructed channel support. In other embodiments, the weight savings of the MCM weight channel support over all-metal constructed weight channel support is between 5% and 10%, 10% and 15%, 15% and 20%, 20% and 25%, 25% and 30%, 30% and 35%, 35% and 40%, and 40% and 45%.

In one example, a weight channel construction 560 with a titanium-PEEK-titanium MCM composition with a first layer 330 thickness of 0.020 inch, a second layer 332 thickness of 0.05 inch, and a third layer 334 thickness between 0.020 inch is 39.4% lighter than an all-titanium construction. In another example, a weight channel construction 560 with a titanium-PPS-titanium MCM composition with a first layer 330 thickness of 0.020 inch, a second layer 332 thickness of 0.05 inch, and a third layer 334 thickness between 0.020 inch is 38.9% lighter than an all-titanium construction.

MCM Constructed Turbulators 442

Described herein are various embodiments of golf club heads comprising a turbulator 442 to improve aerodynamic characteristics of the golf club head by increasing air flow separation distance and, thereby, decreasing drag. The positioning of the turbulator 442 can add additional mass upwards and forwards on the golf club head, which is not ideal for optimizing golf ball performance characteristics. Implementing a lightweight material for a turbulator 442 would give the aerodynamic advantages while minimizing additional mass.

The turbulator 442 can be structured and positioned within the golf club head as described in U.S. patent application Ser. No. 16/724,021, which is fully incorporated herein by reference. In some embodiments, the turbulator 442 can be positioned in the front region 112 of the crown, wherein at least a portion of the turbulator 442 is between the leading edge and the apex. In other embodiments, the turbulator 442 can be positioned on the sole 114. In some embodiments, the golf club head XX comprises turbulators 442 on both the sole 114 and the crown.

In some embodiments, the turbulator 442 comprising the MCM panel 326 can have an internal composite material that may take on the general shape of the turbulator 442. Metal layers can be on the internal side of the composite and on the external side of the composite. The metal layers can act as a coating upon the composite layer, such that the composite layer is encapsulated between the metal layers.

The weight savings of MCM constructed turbulators 442 over stock metal turbulator 442*s* can be up to 25%. The weight savings varies on utilized layer materials and dimensions. In some embodiments, the MCM turbulator 442 can be up to 1%, up to 2%, up to 3%, up to 4%, up to 5%, up to 8%, up to 10%, up to 12%, up to 15%, up to 17%, up to 20%, up to 22%, or up to 25% lighter than a stock metal turbulator 442. In some embodiments, the MCM turbulator 442 can be at least 1%, 2%, 3%, 4%, 5%, 8%, 10%, 12%, 15%, 17%, 20%, 22%, or at least 25% lighter than a stock metal turbulator 442.

MCM Construction for Sound Applications

In addition to weight savings, the MCM panel 326 can be strategically positioned within or upon the golf club head to provide sound and vibration damping. When used in this way, the inclusion of the MCM panel 326 can improve sound and feel during impact with a golf ball. In some examples, structures which, when constructed from the MCM composition 326, may improve sound and feel can include: a crown insert 444, a sole 114 insert, a wraparound insert making up at least a portion of the crown and the sole 114, internal ribs 550, a weight port, or a face insert 802. In these embodiments, the more flexible composite layer of the MCM panel 326 can act as a vibration absorber, minimizing peak amplitude vibration frequencies experienced by the rest of the golf club head. The MCM embodiment comprising z-oriented fibers 220, described above, can improve stiffening characteristics, thereby improving vibration and sound tuning characteristics.

The sound and vibration damping embodiment described below can be implemented in combination with any of the other golf club head MCM components and structures described herein. A crown insert 444 intended to provide vibration damping can have any suitable shape. In some examples, the crown insert 444 can have any one of the following shapes: rectangle, square, triangle, trapezoid, rhombus, circle, oval, or another polygonal shape. In other embodiments, the crown insert 444 can have a shape that generally follows the shape of the crown.

Internal ribs 550 intended to provide vibration damping can be positioned within regions of the club head that experience peak amplitude vibration frequencies. In some examples, the ribs 550 can be positioned upon any one or combination of the following surfaces: the internal surface of the crown, the internal surface of the sole 114, or the internal surface of the skirt, between the crown and the sole 114. The ribs 550 can be angled relative to the face plane, so as to provide the most coverage of peak amplitude frequency regions. The ribs 550 can extend partially or entirely across a length, a width, and/or a depth of the golf club head.

Characteristics of Irons

Figure 12:
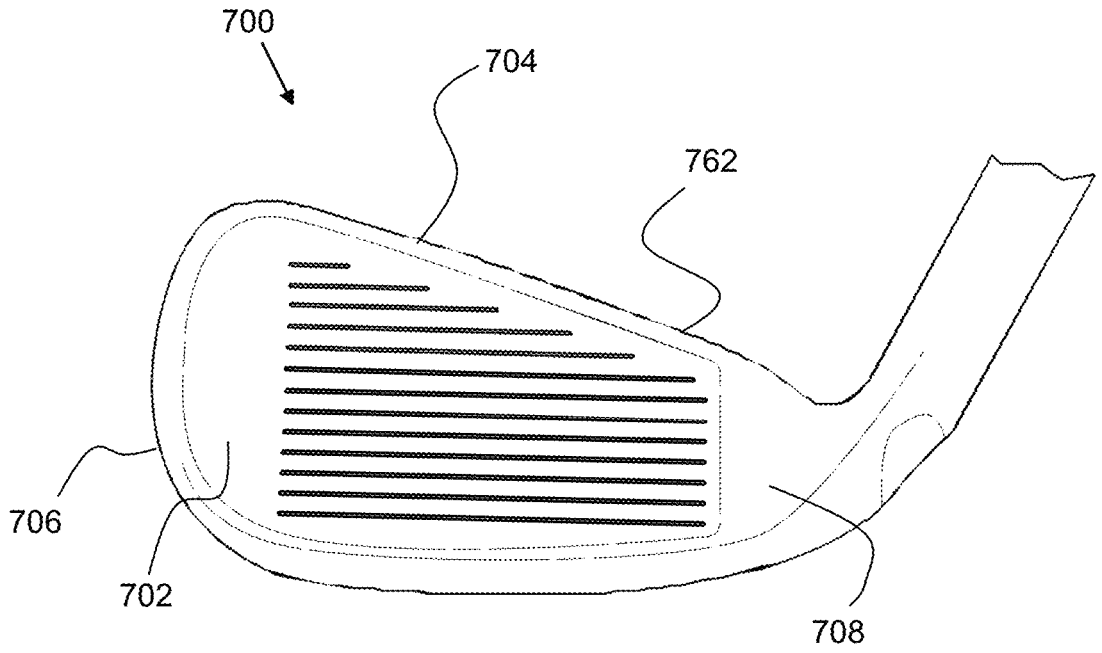
FIG. 12 illustrates a front view of an iron comprising a faceplate, according to a first embodiment.
Figure 13:
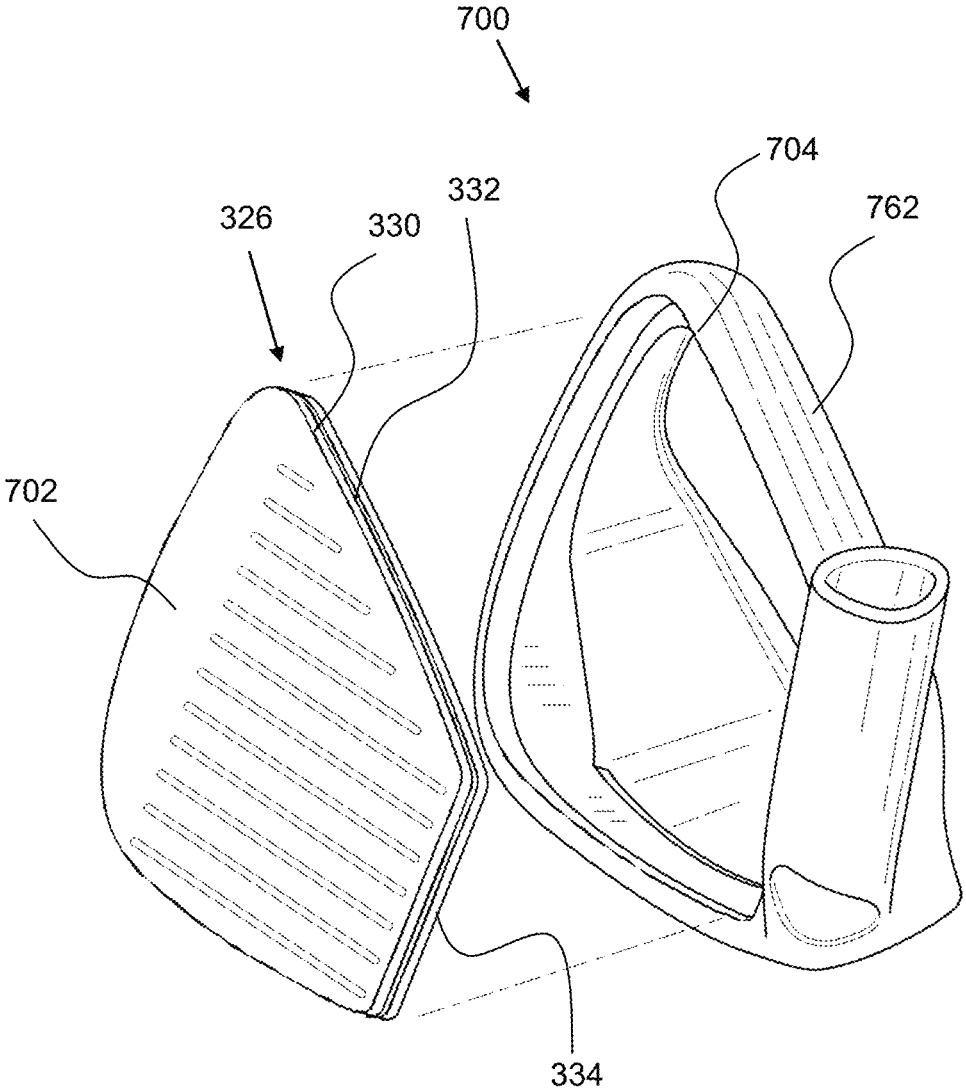
FIG. 13 illustrates a perspective view of an iron-type golf club head comprising a MCM construction faceplate, according to a second embodiment.
Figure 14:
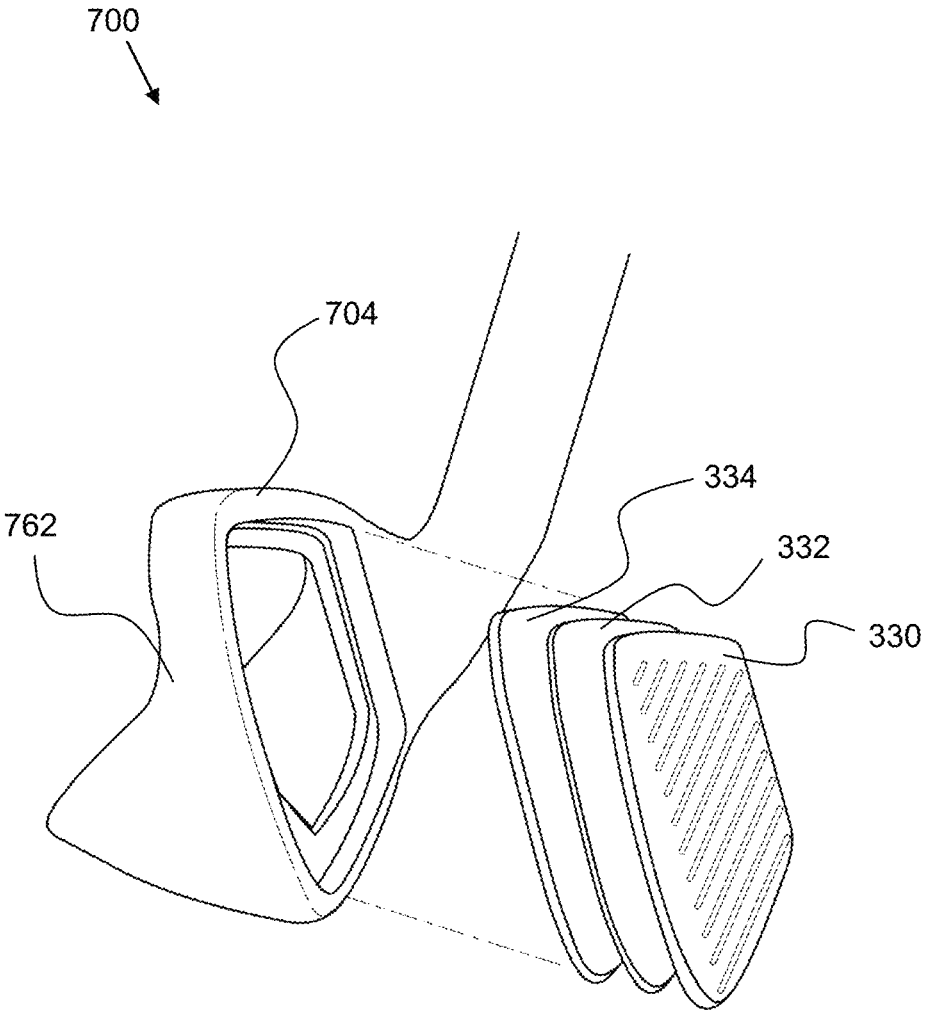
FIG. 14 illustrates an exploded perspective view of the iron-type golf club head of FIG. 13.
Figure 15:
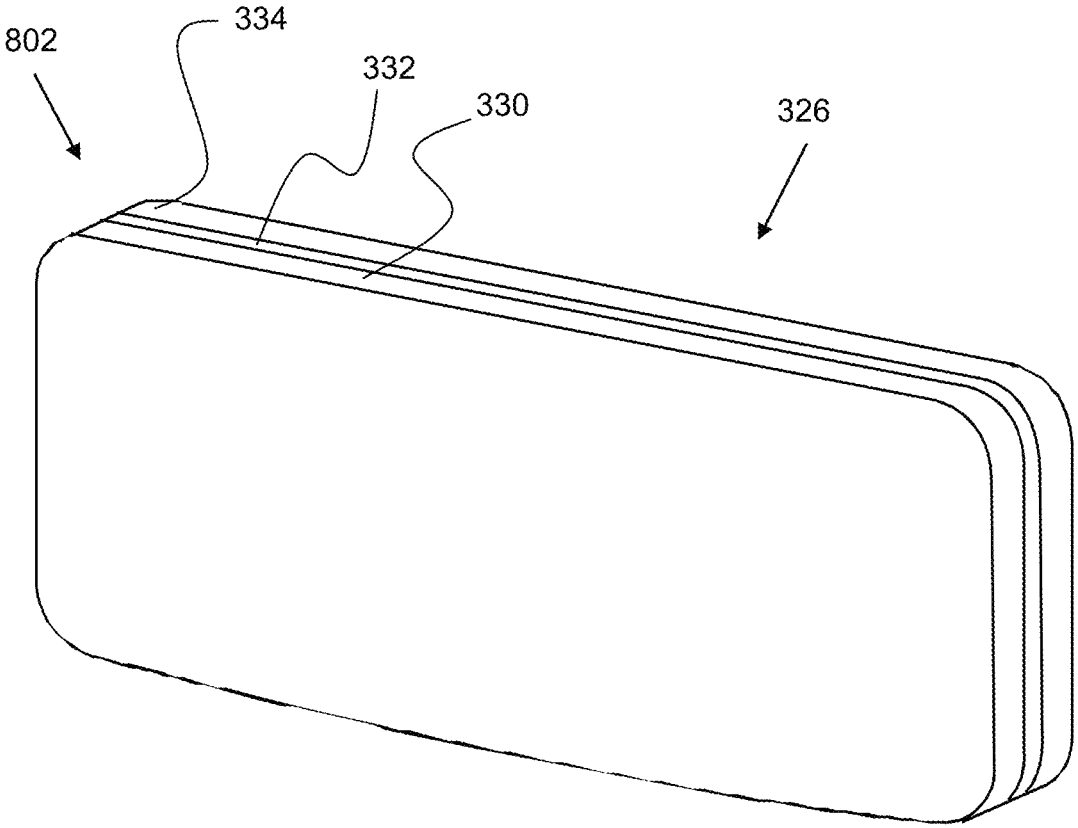
FIG. 15 illustrates a perspective view of a MCM putter face insert, according to a first embodiment.
Figure 16:
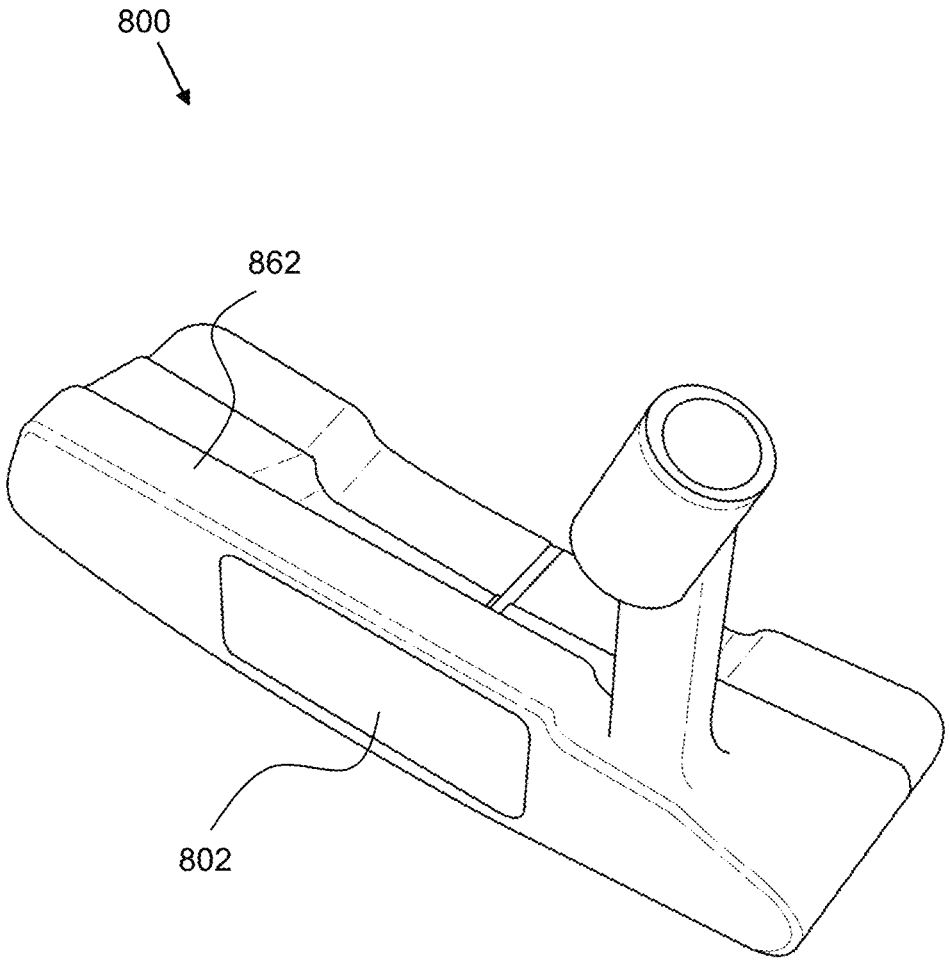
FIG. 16 illustrates a perspective view of a putter-type golf club head, according to a first embodiment.
Figure 17:
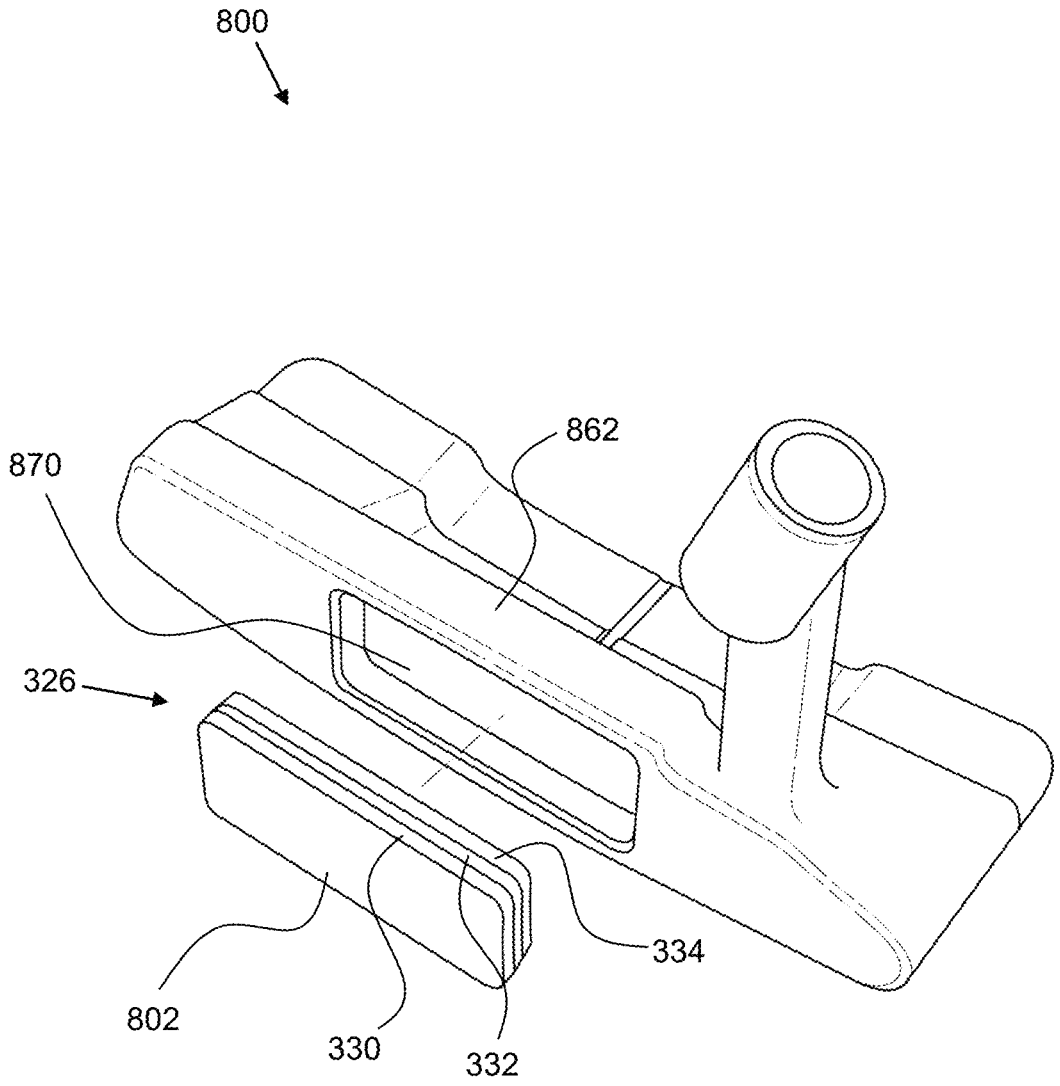
FIG. 17 illustrates a perspective view of the putter-type golf club head of FIG. 16 comprising the MCM putter face insert of FIG. 15.
Figure 18:
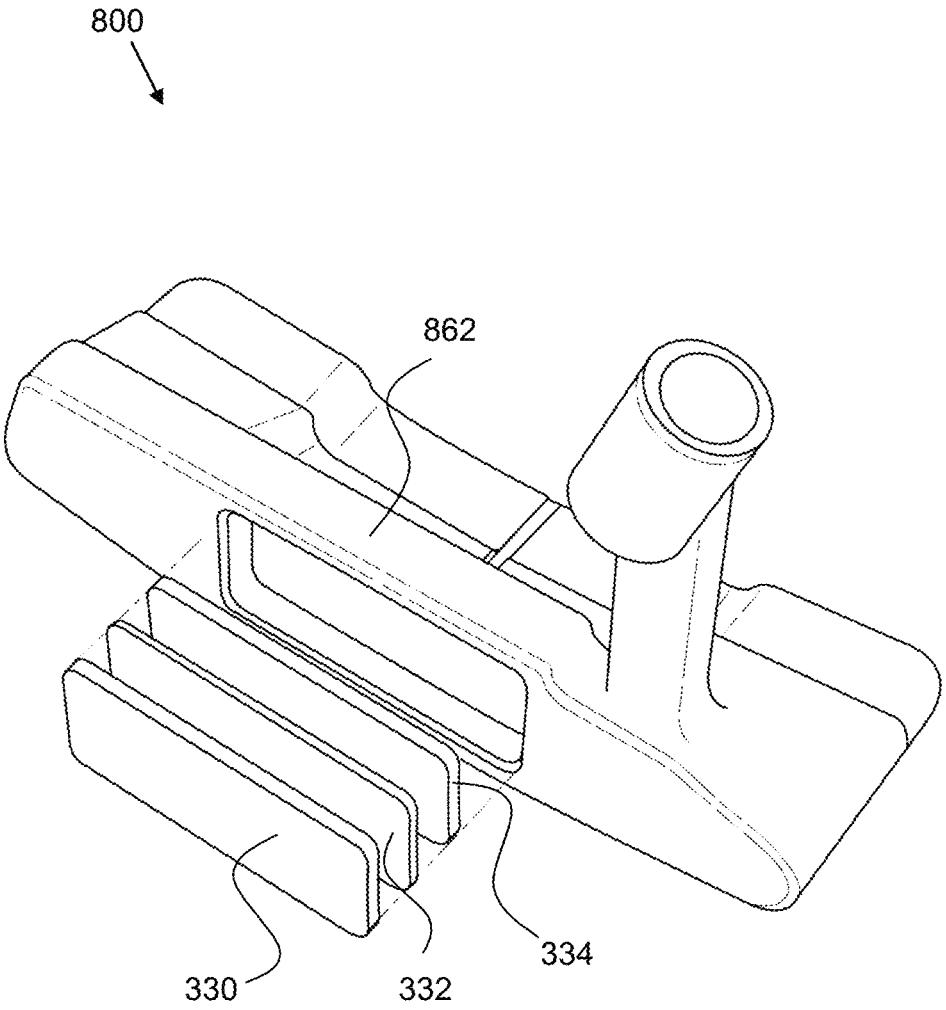
FIG. 18 illustrates an exploded perspective view of the putter-type golf club head of FIG. 17.

Referring to FIGS. 12-14, wherein like reference numerals are used to identify like or identical components in various views. The club head 700 comprises a body 762 having a top rail 704, a sole 714 opposite the top rail 704, a toe end 706, and a heel end 708 opposite the toe end 706. The club head 700 further includes a strike face 702 and a rear 110 opposite the strike face 702. In one embodiment, the strike face 702, the top rail 704, the sole 114, the toe end 706, the heel end 708, and the rear 110 can be integral with each other and form a closed/hollow interior volume. In another embodiment, the strike face 702 and the body 762 can be formed separately and be secured together to form the closed/hollow interior volume. In these embodiments, the closed/hollow interior volume defines a cavity.

In some embodiments, at least portions of the strike face, the rear 710, the top rail, and the sole 714 can be formed from the MCM panel construction 326. In some embodiments, a majority of the hollow body iron golf club head 700 is formed from the MCM construction 326. In other embodiments, traditionally bulkier regions of the golf club head, including areas such as the top rail, heel region, or rear 110 wall, can be selectively formed from the MCM construction 326, while the remaining portions of the golf club head 700 are formed from a metal material.

The strike face can further define a geometric center. In some embodiments, the geometric center can be located at the geometric center point of a striking surface perimeter. In another approach, the geometric center of the strike face 702 can be located in accordance with the definition of a golf governing body such as the United States Golf Association (USGA). For example, the geometric center XX of the striking surface XX can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/_Procedure-For-Measuring-The-Flexibility-Of-A-Golf-Club-Head/) (the "Flexibility Procedure").

MCM Constructed Iron Strike Face

In one embodiment, the MCM composition 326 can be used in an iron type golf club head's strike face. Many features of the iron-type golf club head 700's strike face can be similar to those of the wood-type golf club head's strike face. The strike face 702 comprises a thickness measured from a striking surface to a back surface in a direction extending perpendicular to the loft plane or face plane. The thickness of the strike face 702 can vary such that a maximum thickness of the strike face 702 can be located near the geometric center, and a minimum thickness of the strike face 702 can be located near the perimeter. The thickness of the strike face 702 can range from 0.05 to 0.20 inch. In some embodiments, the thickness of the strike face 702 can range from 0.05 to 0.125, or 0.12 to 0.20 inch. In some embodiments, the thickness of the strike face 702 can range from 0.05 to 0.10, 0.06 to 0.11, 0.07 to 0.12, 0.08 to 0.13, 0.09 to 0.14, or 0.10 to 0.15 inch. For example, the thickness of the strike face XX can be 0.05, 0.06, 0.065, 0.07, 0.075, 0.08, 0.085, 0.09, 0.095, 0.10, 0.11, 0.12, 0.13, 0.14, 0.15, 0.16, 0.17, 0.18, 0.19, or 0.20 inch.

In some embodiments, the minimum and maximum mass of the strike face XX comprising the MCM sandwich 326 described herein can be up to 30% lighter than that of a strike face 702 comprising a stock metal composition. In some examples, the MCM strike face can be up to 2%, up to 4%, up to 6%, up to 8%, up to 10%, up to 12%, up to 14%, up to 16%, up to 18%, up to 20%, up to 22%, up to 24%, up to 26%, up to 28%, or up to 30% lighter than a stock metal strike face.

In one example, a strike face construction that has a titanium-PEEK-titanium composition with a first layer 330 thickness of 0.05 inch, a second layer 332 thickness of 0.025 inch, and a third layer 334 thickness of 0.05 inch is 13.6% lighter than an all-titanium construction. In another example, a faceplate 402 construction that has a titanium-PPS-titanium composition with a first layer 330 thickness of 0.05 inch, a second layer 332 thickness of 0.025 inch, and a third layer 334 thickness of 0.05 inch is 13.5% lighter than an all-titanium construction. In another example, a faceplate 402 construction that has a titanium-PEEK-titanium composition with a first layer 330 thickness of 0.05 inch, a second layer 332 thickness of 0.05 inch, and a third layer 334 thickness of 0.05 inch is 22.8% lighter than an all-titanium construction. In another example, a faceplate 402 construction that has a titanium-PPS-titanium composition with a first layer 330 thickness of 0.05 inch, a second layer 332 thickness of 0.05 inch, and a third layer 334 thickness of 0.05 inch is 22.5% lighter than an all-titanium construction.

Characteristics of Putters

The MCM composition 326 can replace portions of a putter-type golf club head 800. In some embodiments, one or a combination of the following components of a putter-type golf club head 800 can be constructed from the MCM composition 326: face insert 802, faceplate 402, crown, or sole 114. In some embodiments, a majority of the putter-type golf club head 800 can be constructed from the MCM composition 326.

MCM Constructed Putter Strike Face

Referring to FIGS. 15-18, in one embodiment, the strike face 402 or insert 802 can comprise the MCM composition 326. The putter-type face insert 802 can be similar in many ways to the wood-type golf club head faceplate 402. The dimensions and shape of the strike face insert 802 can be reflective of a typical putter-type golf club head 800 face insert 802. Replacing a putter-type golf club head's 800 traditional metallic material strike face insert 802 with the MCM panel 326 can reduce mass in the front region 112 of the club head, thereby increasing discretionary mass, leading to potential for improvements in characteristics such as CG positioning and MOI.

The strike face can be secured to the club head body. In these embodiments, the upper portion can comprise an insert cavity 870. The insert cavity 870 can be configured to receive the face insert 802. The strike face 802 can be secured by an adhesive such as glue, very high bond (VHB™) tape, epoxy or another adhesive. Alternately, or additionally, the strike face 802 can be secured by welding, soldering, screws, rivets, pins, mechanical interlock structure, or another fastening method.

The ball striking faceplate 402 or the face insert 802 can comprise a thickness. In many embodiments, the thickness of the face insert 802 can range from 0.015 to 0.115 inch. In some embodiments, the thickness of the face insert 802 can range from 0.015 to 0.045 inch, 0.020 to 0.050 inch, 0.025 to 0.055 inch, 0.050 to 0.100 inch, 0.055 to 0.105 inch, 0.060 to 0.110, or 0.065 to 0.115 inch. In some embodiments, the thickness of the face insert 802 can be at least 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. In some embodiments, the thickness of the face insert 802 can be greater than or equal to 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. In some embodiments, the thickness of the face insert 802 can be less than or equal to 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. For example, the thickness of the face insert 802 can be 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch.

In other embodiments, the thickness of the face insert 802 can range from 0.115 to 0.40 inch. In some embodiments, the thickness of the face insert 802 can range from 0.115 to 0.20 inch, 0.15 to 0.30 inch, 0.20 to 0.30 inch, 0.25 to 0.35 inch, or 0.30 to 0.40 inch. In some embodiments, the thickness of the face insert 802 can be at least 0.15, 0.20, 0.25, 0.30, 0.35, or 0.40 inch. In some embodiments, the thickness of the face insert 802 can be greater than or equal to 0.15, 0.20, 0.25, 0.30, 0.35, or 0.40. In some embodiments, the thickness of the face insert 802 can be less than or equal to 0.15, 0.20, 0.25, 0.30, 0.35, or 0.40 inch. For example, the thickness of the face insert 802 can be 0.15, 0.20, 0.25, 0.30, 0.35, or 0.40 inch.

In some embodiments, the minimum and maximum mass of the face insert 802 comprising the MCM sandwich 326 described herein can be up to 70% lighter than that of a strike face insert 802 comprising a stock metal composition. In some examples, the MCM strike face insert 802 can be up to 2%, 4%, 6%, 8%, 10%, 12%, 14%, 16%, 18%, 20%, 22%, 24%, 26%, 28%, 30%, 32%, 34%, 36%, 38%, 40%, 42%, 44%, 46%, 48%, 50%, 52%, 54%, 56%, 58%, 60%, 62%, 64%, 66%, 68%, or up to 70% lighter than a stock metal strike face. In one example, the MCM strike face insert 802 is 69.2% lighter than an all-metal construction.

In one example, a strike face insert 802 construction that has a titanium-PEEK-titanium composition with a first layer 330 thickness of 0.08 inch, a second layer 332 thickness of 0.04 inch, and a third layer 334 thickness of 0.08 inch is 14.2% lighter than an all-titanium construction. In another example, a strike face insert 802 construction that has a titanium-PPS-titanium composition with a first layer 330 thickness of 0.08 inch, a second layer 332 thickness of 0.04 inch, and a third layer 334 thickness of 0.08 inch is 14.0% lighter than an all-titanium construction.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Method of Manufacturing

In many embodiments, the golf club head body can be cast from a metal material. The metal material can be any one or combination selected from the following: titanium (Ti), titanium alloy (e.g. Ti-6-4, Ti-8-1-1, T-9S, or BE α-β Ti alloy), aluminum (Al), aluminum alloy, steel, steel alloy, tin, tin alloy, or any other suitable metallic material. The body can be cast or machined to comprise an aperture or opening 136 configured to receive a faceplate 102. The metal layers (330, 334) of a faceplate 102 can be forged, cast, or cast and then forged. Grooves and other features can then be machined into either or both of the first and third metal layers (330, 334).

The second (composite) layer 332 can be formed by compression molding. The composite layer 332 can include a polymer and fibers 224 having any one or combination of the materials described above. In many embodiments, the composite layer 332 can be formed in layers, whereby a single layer of polymer and fibers 224 is formed and cured before another, identical or nearly identical layer is added. In some embodiments, discontinuous or chopped fibers are used. In other embodiments, unidirectional sheets of fibers are used. In further embodiments, woven fiber sheets can also be used. Fibers 224 can be oriented in one or multiple directions within each layer. In some embodiments, fibers 224 are oriented in different directions in some or all of the layers. The fiber-reinforced composite can be built up in these layers until the desired thickness is achieved. The layers can each have the same or different thicknesses. The layers are stacked and coupled to form a laminate. One or more laminates can form the second layer 332 of the MCM panel 326.

The first, second, and third layers (330, 332, 334) can be shaped individually as needed, prior to coupling. Processing steps such as cutting, pressing, stamping, and machining can be used on any of the three layers to form the desired shape, structure, and size. In many embodiments, a combination of heat and pressure can be used to combine the three layers to form the MCM panel 326.

In these embodiments, pressure ranging from 50 psi to 1000 psi can be used to press the layers (330, 332, 334) together. In some embodiments, pressure used to combine the layers (330, 332, 334) can be between 50 psi and 100 psi, 100 psi and 150 psi, 150 psi and 200 psi, 200 psi and 250 psi, 300 psi and 350 psi, 350 psi and 400 psi, 400 psi and 450 psi, 450 psi and 500 psi, 500 psi and 550 psi, 550 psi and 600 psi, 600 psi and 650 psi, 650 psi and 700 psi, 700 psi and 750 psi, 750 psi and 800 psi, 800 psi and 850 psi, 850 psi and 900 psi, 900 psi and 950 psi, or 950 psi and 1000 psi. In some embodiments, pressure used to combine the layers (330, 332, 334) can be less than 100 psi, less than 200 psi, less than 300 psi, less than 400 psi, less than 500 psi, less than 600 psi, less than 700 psi, less than 800 psi, less than 900 psi, or less than 1000 psi.

In some embodiments, an epoxy or other adhesive is used to combine the three layers (330, 332, 334). The epoxy or adhesive can be used with or without the heat and pressure, as described above. In other embodiments, a mechanical fastener, such as a rivet or rivets, could be used to secure the three layers (330, 332, 334) together. In some embodiments, an epoxy or adhesive can be used in combination with a mechanical fastener.

Following creation and shaping of the MCM panel 326, the component formed can then be attached to the golf club head. This can be done by way of welding, mechanical fastening, adhering, or any combination thereof. In many embodiments, the edges of the component that abut the golf club head body can be welded to the golf club head body to secure the component into place. Any one or combination of the following types of welding can be used to couple the MCM panel 326 component to the golf club head body: pulse plasma welding, continuous laser welding, laser-hybrid welding, arc welding, or any other suitable welding method.

EXAMPLES i. Example 1: Property Comparisons for MCM Sandwich Samples Vs Stock Ti Sheet

TABLE 1

| | 350 PSI Ti/PEI | 700 PSI Ti/PEI | Stock Ti |
|---|---|---|---|
| Mass | 247.7 | 242.8 | 261 |
| Thickness (inches) | 0.154 | 0.142 | 0.131 |

MCM sandwich panels were compared to Ti only sheet samples. Series of tests were run on three types of samples: MCM sandwich panels composed of 350 PSI Ti/polyethylenimine (PEI), MCM sandwich panels composed of 700 PSI Ti/PEI and on a stock Ti sheet. The MCM sandwich panels for this example are composed of three layers. The first layer is a Ti 6-4 sheet that is 0.05 inches thick. The second layer is a PEI z-axis reinforced composite that is 0.025 inches thick. The third layer is the same as the first layer; a Ti 6-4 sheet that is 0.05 inches thick. These three layer components are compression molded together at 350 PSI for one sample and then at 700 PSI for a second sample. The properties of mass and thickness in these three samples is displayed in Table 1. It is important to note the weight savings that was achieved even while increasing the thickness for each Ti/PEI MCM sandwich over the stock Ti sample. The 350 PSI Ti/PEI sample is 17.6% thicker than the stock Ti, but is still 5.1% lighter. The 700 PSI Ti/PEI sample is 8.4% thicker than the stock Ti, but is still 7.0% lighter. The ability to have a thicker panel without adding weight gives insight into the MCM's CT and COR measurements potential. Thickness and weight measurements go into getting comparative strength and bending properties as metals while saving weight.

II. Example 2: Three-Point Bend Test Comparison for MCM Sandwich Samples Vs Stock Ti Sheet

TABLE 2

| | Ti A | Ti B | Ti-PEI (350 PSI) | Ti-PEI (700 PSI) |
|---|---|---|---|---|
| Avg Max Force (lbf) | 800.53 | 921.59 | 1238.01 | 1093.76 |
| Avg Flexural Modulus (ksi) | 17110.6 | 17610.4 | 16072.65 | 15239.36 |

Three-point bend testing was performed on MCM sandwich panels composed of 350 PSI Ti/PEI, composed of 700 PSI Ti/PEI and on two stock Ti sheets (e.g. Ti A and Ti B). The MCM sandwich panels for this example are composed of three layers. The first layer is a Ti 6-4 sheet that is 0.05 inches thick. The second layer is a PEI z-axis reinforced composite that is 0.025 inches thick. The third layer is the same as the first layer; a Ti 6-4 sheet that is 0.05 inches thick. These three layer components are compression molded together at 350 PSI for one sample and then at 700 PSI for a second sample. All four samples (MCM sandwiches and stock Ti) were put into the apparatus to evaluate flexural response. Both MCM sandwich samples had higher maximum force results than the stock Ti samples. Both MCM sandwich samples had lower flexural modulus values compared to the stock Ti samples. The goal is to create a MCM sandwich that has a comparable flexural modulus to that or stock Ti and other stock metals. The difference in flexural modulus between the two MCM sandwich samples shows that compression pressure can be used to produce desirable modulus values. Data shows the ability to obtain comparative strength and bending properties as metals while saving weight. Because average max force is greater in both of the MCM sandwich samples than in the Ti samples, the MCM sandwich maintains or increases strength of the panel. The minimal differences in average flexural modulus between the MCM sandwich samples and the Ti samples shows that the MCM sandwich samples maintain flexibility of the panel.

III. Example 3: COR Testing Comparison for MCM Sandwich Samples Vs Stock Ti Sheet

TABLE 3

| | 350 PSI Ti/PEI | 700 PSI Ti/PEI | Stock Ti |
|---|---|---|---|
| COR | 0.792 | 0.798 | 0.816 |

Coefficient of restitution (COR) testing performed on MCM sandwich panels composed of 350 PSI Ti/PEI, composed of 700 PSI Ti/PEI and on a stock Ti sheet. The MCM sandwich panels for this example are composed of three layers. The first layer is a Ti 6-4 sheet that is 0.05 inches thick. The second layer is a PEI z-axis reinforced composite that is 0.025 inches thick. The third layer is the same as the first layer; a Ti 6-4 sheet that is 0.05 inches thick. These three layer components are compression molded together at 350

PSI for one sample, and then at 700 PSI for a second sample. All three samples (MCM sandwiches and stock Ti) were put through testing to obtain COR. COR values for both Ti/PEI composite samples were slightly lower than the stock Ti reference. It is important to note that the COR values for the 350 PSI Ti/PEI and the 700 PSI Ti/PEI are only 2.9% and 2.2%, respectively, lower than the stock Ti even though they are 17.6% and 8.4% thicker, respectively. These results show that there is room to manipulate the MCM panel's construction (thickness, geometry, material make-up, etc.) to improve golf ball speed and performance. Data shows the ability to obtain comparative strength and bending properties as metals while saving weight. The minimal differences in COR between the MCM sandwich samples and the Ti sample shows that the MCM sandwich samples maintain COR of the panel.

IV. Example 4: CT Testing Comparison for MCM Sandwich Samples Vs Stock Ti Sheet

TABLE 4

| | 350 PSI Ti/PEI | 700 PSI Ti/PEI | Stock Ti |
|---|---|---|---|
| CT (ms) | 222 | 232 | 247 |

Characteristic timing (CT) testing performed on MCM sandwich panels composed of 350 PSI Ti/PEI, composed of 700 PSI Ti/PEI and on a stock Ti sheet. The MCM sandwich panels for this example are composed of three layers. The first layer is a Ti 6-4 sheet that is 0.05 inches thick. The second layer is a PEI z-axis reinforced composite that is 0.025 inches thick. The third layer is the same as the first layer; a Ti 6-4 sheet that is 0.05 inches thick. These three layer components are compression molded together at 350 PSI for one sample, and then at 700 PSI for a second sample. All three samples (MCM sandwiches and stock Ti) were put through testing to obtain CT. There was a significant reduction in CT for both MCM sandwich samples relative to the stock Ti sample. These results show that there is room to manipulate the MCM panel's construction (thickness, geometry, material make-up, etc.) to improve CT. Improving CT values can optimize ball speed and overall club performance. Data shows the ability to obtain comparative strength and bending properties as metals while saving weight. The minimal differences in CT between the MCM sandwich samples and the Ti sample shows that the MCM sandwich samples maintain CT of the panel.

V. Example 5: Durability Testing Comparison for MCM Sandwich Samples Vs Stock Ti Sheet

TABLE 5

| | 350 PSI Ti/PEI | 700 PSI Ti/PEI | Stock Ti |
|---|---|---|---|
| Total Hits to Failure | 2150 | 1165 | 1000 |

Durability testing performed on MCM sandwich panels composed of 350 PSI Ti/PEI, composed of 700 PSI Ti/PEI and on a stock Ti sheet showed improvements in durability. The MCM sandwich panels for this example are composed of three layers. The first layer is a Ti 6-4 sheet that is 0.05 inches thick. The second layer is a PEI z-axis reinforced composite that is 0.025 inches thick. The third layer is the same as the first layer; a Ti 6-4 sheet that is 0.05 inches thick. These three layer components are compression molded together at 350 PSI for one sample, and then at 700 PSI for a second sample. All three samples (MCM sandwiches and stock Ti) were put in an air cannon to test durability. Durability testing in the air cannon was performed to ensure that the MCM sandwich has similar life to the stock Ti sheet. Table 5 depicts the total number of hits each sample was able to withstand before failure. The number of hits withstood for the MCM sandwich panel was over double that of the stock Ti sheet (115% more hits before failure). The increase in total hits til failure of the MCM sandwich samples over the Ti sample shows the durability improvements of the panel.

VI. Example 6: MOI Comparison in Driver

TABLE 6

Mass Properties - Driver Embodiments

| | Stock | Faceplate + Weight Channel Support w/MCM construction | Faceplate w/MCM construction | Weight Channel Support w/MCM construction |
|---|---|---|---|---|
| Mass (g) | 204.1 | 204.0 | 204.0 | 204.0 |
| CGx(in) | −0.042 | −0.053 | −0.044 | −0.051 |
| CGy(in) | 0.828 | 0.796 | 0.797 | 0.827 |
| CGz(in) | −1.988 | −2.175 | −2.142 | −2.019 |
| Ixx (g*in^2) | 673.4 | 711.6 | 696.5 | 689.8 |
| Iyy (g*in^2) | 897.7 | 930.0 | 916.7 | 912.6 |

TABLE 7

Mass Properties Relative to Stock Construction

| | Faceplate + Weight Channel Support w/MCM construction | Faceplate w/MCM construction | Weight Channel Support w/MCM construction |
|---|---|---|---|
| Mass (g) | −0.1 | −0.1 | −0.1 |
| CGx(in) | −0.011 | −0.002 | −0.009 |
| CGy(in) | −0.032 | −0.031 | −0.001 |
| CGz(in) | −0.188 | −0.154 | −0.031 |
| Ixx (g*in^2) | +5.67% | +3.42% | +2.44% |
| Iyy (g*in^2) | +3.60% | +2.11% | +1.66% |

Golf club heads of a driver construction were simulated with redistributed weight based on the MCM construction's placement and application. Three constructions were compared to a stock construction: a driver head with a MCM faceplate, a driver head with a MCM weight channel support, and a driver head with a MCM faceplate and a MCM weight channel support. Remaining mass in these three constructions was reassigned as discretionary mass and was added to the tungsten weight attachment on the back of the club head. The mass properties for those three constructed examples and the stock build of the club are displayed in Table 6. The mass properties relative to the stock build are displayed in Table 7. It is important to note the increase in MOI when the MCM construction was utilized in all three example constructions over the stock club head construction. It is ideal to have a golf club head with high MOI (that stays within USGA regulations) as it will reduce the twisting effects of off-center hits on the club face to optimize club head performance. It is also important to note the CG location, specifically in the y- and z-direction, is moved lower and more rearward when compared to the stock construction. Balancing a low and rearward CG placement can produce better golf ball spin values. Thus, this combination of low and rearward placed CG can improve the forgiveness and provide optimized golf ball flight performance characteristics. The increase in MOI of the MCM sandwich constructions over the metal constructions shows the forgiveness improvements.

VII. Example 7: MOI Comparison in Iron

TABLE 8

Mass Properties - Iron Embodiments

| | Stock-All Steel | | | All Steel (Reduced Mass) | | | MCM Strike Face Construction | | |
|---|---|---|---|---|---|---|---|---|---|
| | Total | Body | Face | Total | Body | Face | Total | Body | Face |
| Mass (g) | 278.2 | 212.7 | 65.5 | 245.7 | 180.2 | 65.5 | 245.7 | 212.7 | 33.0 |
| CGx(in) | | 0.028 | | | 0.013 | | | 0.078 | |
| CGy(in) | | 0.538 | | | 0.546 | | | 0.511 | |
| CGz(in) | | −0.531 | | | −0.529 | | | −0.537 | |
| MOIxx(g*in^2) | | 114.3 | | | 99.6 | | | 105.2 | |
| MOIyy(g*in^2) | | 488.1 | | | 421.2 | | | 462.5 | |
| MOIxx relative to all-steel construction (reduced mass) | | | | | | | | +5.6% | |
| MOIyy relative to all-steel construction (reduced mass) | | | | | | | | +9.8% | |

The MCM construction was implemented into the strike face of an iron body golf club head. Mass properties of three different iron constructions are displayed in Table 8: a stock all-steel construction, a reduced mass all-steel construction, and a MCM strike face construction. The reduced mass iron construction works as a direct comparison tool for the iron constructed with the MCM construction. The MCM strike face is 49.6% lighter than the steel constructed strike faces of the other two irons. Redistributing that saved mass into the body of the iron, specifically reallocating weight to the perimeter of the iron, allows for increased MOI over the all-steel iron of the same weight as the MOIxx increased by 5.6% and the MOIyy increased by 9.8%. It is important to directly compare the golf club heads of the same overall mass with different mass distributions for parts since changes in overall head mass will influence the MOI. Comparing club heads with the same overall mass highlights the improvements the utilization of the light weight MCM has on golf club head performance. The increase in MOI of the MCM sandwich constructions over the metal constructions shows the forgiveness improvements.

VIII. Example 8: MOI Comparison in Putter

TABLE 9

Mass Properties - Putter Embodiments

| | Stock-All Steel Face | | | All Steel Face (Reduced Mass) | | | MCM Face Construction | | |
|---|---|---|---|---|---|---|---|---|---|
| | Total | Body | Face | Total | Body | Face | Total | Body | Face |
| Mass (g) | 366.7 | 340.7 | 26.0 | 348.7 | 322.7 | 26.0 | 348.7 | 340.7 | 8.0 |
| CGx(in) | | 0.058 | | | 0.058 | | | 0.061 | |
| CGy(in) | | 0.556 | | | 0.556 | | | 0.559 | |
| CGz(in) | | −0.107 | | | −0.106 | | | −0.127 | |
| MOIxx(g*in^2) | | 181.5 | | | 172.1 | | | 178.0 | |
| MOIyy(g*in^2) | | 676.9 | | | 641.7 | | | 670.2 | |
| MOIxx relative to all-steel construction (reduced mass) | | | | | | | | +3.4% | |
| MOIyy relative to all-steel construction (reduced mass) | | | | | | | | +4.4% | |

The MCM construction was implemented into the strike face insert of a putter golf club head. Mass properties of three different putter constructions are displayed in Table 9: a stock all-steel face insert construction, a reduced mass all-steel face insert construction, and a MCM face insert construction. The reduced mass putter construction works as a direct comparison tool for the putter constructed with the MCM construction. The MCM face insert is 69.2% lighter than the steel constructed faces of the other two putters. Redistributing that saved mass into the body of the putter, specifically into custom-weight system elements, allows for an increased MOI over the all-steel face insert putter of the same weight as the MOIxx increased by 3.4% and the MOIyy increased by 4.4%. Increasing MOI in a putter can reduce the twisting effects of off-center and misshit putts to improve forgiveness. Thus, the increase in MOI of the MCM sandwich constructions over the metal constructions shows the forgiveness improvements.

Clauses

Clause 1. A golf club head comprising: a body and a faceplate; and a metal-composite-metal construction, the metal-composite-metal construction comprising: a first layer, a second layer, and a third layer; wherein the first layer is composed of a metallic material; wherein the second layer is composed of a fiber-reinforced composite material; and wherein the third layer is composed of a metallic material; wherein the metal-composite-metal construction makes up at least a portion of the golf club head.

Clause 2. The golf club head of clause 1, wherein the golf club head comprises at least one of the following structures being composed of the metal-composite-metal construction: faceplate, face insert, internal ribs, turbulators, crown insert, or weight channel.

Clause 3. The golf club head of clause 2, further comprising the metal-composite-metal faceplate; wherein the metal-composite-metal faceplate comprises a mass that is up to 50% less than a mass of an identical faceplate made of a metallic material.

Clause 4. The golf club head of clause 2, further comprising the metal-composite-metal internal ribs; wherein the metal-composite-metal internal ribs comprise a mass that is up to 25% less than a mass of identical ribs made of a metallic material.

Clause 5. The golf club head of clause 2, further comprising the metal-composite-metal weight channel; wherein the metal-composite-metal weight channel comprises a mass that is up to 40% less than a mass of an identical weight channel made of a metallic material.

Clause 6. The golf club head of clause 1, wherein the second layer further comprises a plurality of uni-direction fibers, multi-directional fibers, or a combination of uni- and multi-directional fibers.

Clause 7. The golf club head of clause 1, wherein the first and third layers comprises a metallic peripheral edge; and wherein the second layer comprises a composite peripheral edge; wherein the metal-composite-metal construction further comprises an offset distance measured between the metallic peripheral edge and the composite peripheral edge; and wherein a perimeter region is defined by the offset distance.

Clause 8. The golf club head of clause 4, wherein the offset distance is no more than 0.75 inch.

Clause 9. The golf club head of clause 5, wherein the first layer and the third layer abut one another within the perimeter region.

Clause 10. The golf club head of clause 6, wherein the offset region is devoid of the second layer.

Clause 11. The golf club head of clause 1, wherein the first layer and the third layer define a pocket which houses the second layer.

Clause 12. The golf club head of clause 1, wherein the fiber-reinforced composite material of the second layer is a laminate formed from multiple sheets of fiber-reinforced composite material; wherein the second layer comprises a forward sheet, a middle sheet, and a rearward sheet; wherein the forward sheet abuts the first layer, the rearward sheet abuts the third layer, and the middle sheet is disposed between the forward sheet and the rearward sheet.

Clause 13. The golf club head of clause 1, wherein the golf club head defines a loft plane, tangent to a geometric center of the face insert, and a z-axis perpendicular to the loft plane; wherein a portion of the reinforcing fibers of the fiber-reinforced composite material are oriented between 0 degrees and 45 degrees of the z-axis.

Clause 14. The golf club head of clause 10, wherein the club head defines an x-axis perpendicular to the z-axis, and parallel to a ground plane; wherein the remaining reinforcing fibers of the fiber-reinforced composite material are generally oriented in the x-axis direction.

Clause 15. The golf club head of clause 1, wherein the metallic materials of the first and third layers are any one or combination of the following materials: titanium (Ti), titanium alloy (e.g. Ti-6-4, Ti-8-1-1, T-9S, or BE $\alpha$-$\beta$ Ti alloy), aluminum (Al), aluminum alloy, steel, steel alloy, tin, or tin alloy.

Clause 16. The golf club head of clause 12, wherein the first and third layer are composed of the same metallic material.

Clause 17. The golf club head of clause 1, wherein the first layer material has a first layer density, the second layer material has a second layer density, and the third layer material has a third layer density; and wherein the second layer density is less than the first layer density and the third layer density.

Clause 18. The golf club head of clause 1, wherein the fiber-reinforced composite material of the second layer comprises one of combination of materials selected from the following: polyethylenimine (PEI), polyether ether ketone (PEEK), polyaryletherketone (PAEK), thermoplastic polyurethane (TPU), polyphthalamide (PPA), Nylon 6 (6-6, 11, 12), polyphenylene (PPS).

Clause 19. The golf club head of clause 1, wherein the fiber-reinforced composite material of the second layer comprises natural and synthetic fibers selected from the following: carbon fiber, glass fiber, Kevlar fiber, natural fiber, ultra-high molecular weight polyethylene (UHMWPE) fiber, or any suitable fiber.

Clause 20. The golf club head of clause 1, wherein the portion of the golf club head formed from the metal-composite-metal construction reduces a total mass of the golf club head by up to 20%.

Clause 21. A wood-type golf club head comprising a body and a face insert, wherein the body comprises a front end, a rear end, a crown; a sole, a skirt, a heel side, and a toe side; wherein the body defines a hollow interior, the face insert is configured to be secured to the body, the face insert comprises an outer metal layer, an inner metal layer, and a composite panel disposed between the outer metal layer and the inner metal layer; wherein the composite panel is formed from a thermoplastic resin and reinforcing fibers.

Clause 22. The golf club head of clause 21, wherein the composite panel comprises a forward portion, a middle portion, and a rearward portion; wherein the forward portion abuts the outer metal layer, the rearward portion abuts the inner metal layer, and the middle portion is disposed between the forward portion and the rearward portion.

Clause 23. The golf club head of clause 21, wherein the club head defines a loft plane, tangent to a geometric center of the face insert, and a z-axis perpendicular to the loft plane; wherein the reinforcing fibers of the middle portion are oriented between 0 degrees and 45 degrees of the z-axis.

Clause 24. The golf club head of clause 21, the face insert further comprises a peripheral edge; the face insert further comprises a perimeter region defined by an offset distance from the peripheral edge.

Clause 25. The golf club head of clause 24, wherein the offset distance is no more than 0.75 inch.

Clause 26. The golf club head of clause 25, wherein a perimeter region is defined by at least a portion of the offset distance; and wherein the outer metal layer and the inner metal layer abut one another within the perimeter region.

Clause 27. The golf club head of clause 26, wherein the offset region is devoid of the composite panel.

Clause 28. The golf club head of clause 21, wherein the outer metal layer and the inner metal layer define a pocket which houses the composite layer.

Clause 29. The golf club head of clause 25, wherein the offset region is 0.35 inch.

Clause 30. The golf club head of clause 21, wherein the inner metal layer comprises a variable thickness.

Clause 31. The golf club head of clause 21, wherein the composite panel comprises a polymer selected from the following: polyethylenimine (PEI), polyether ether ketone (PEEK), polyaryletherketone (PAEK), thermoplastic polyurethane (TPU), polyphthalamide (PPA), Nylon 6 (6-6, 11, 12), polyphenylene (PPS).

Clause 32. The golf club head of clause 31, wherein the composite panel comprises a polymer made of polyethylenimine (PEI).

Clause 33. The golf club head of clause 21, wherein the fibers are selected from the following: carbon fiber, glass fiber, Kevlar fiber, natural fiber, ultra high molecular weight polyethylene (UHMWPE) fiber, or any suitable fiber.

Clause 34. The golf club head of clause 21, wherein the face insert is laser welded to the body.

Clause 35. The golf club head of clause 21, wherein the metal layers are formed from any one or combination of the following materials: titanium (Ti), titanium alloy (e.g. Ti-6-4, Ti-8-1-1, T-9S, or BE α-β Ti alloy), aluminum (Al), aluminum alloy, steel, or steel alloy.

Clause 36. The golf club head of clause 21, wherein the outer metal layer, inner metal layer, and composite panel define a peripheral edge of the face insert, such that the outer metal layer, inner metal layer, and composite layer terminate along a single plane to form the peripheral edge.

Clause 37. The golf club head of clause 21, wherein the face insert is a face cup.

The invention claimed is:

1. A golf club head comprising:

a body and a faceplate; and a metal-composite-metal construction, the metal-composite-metal construction comprising:

a first layer, a second layer, and a third layer;

wherein the first layer is composed of a metallic material;

wherein the second layer is composed of a fiber-reinforced composite material; and wherein the third layer is composed of a metallic material;

wherein the first and third layers further comprise a metallic peripheral edge; and wherein the second layer further comprises a composite peripheral edge; wherein the metal-composite-metal construction further comprises an offset distance measured between the metallic peripheral edge and the composite peripheral edge; and wherein a perimeter region is defined by the offset distance;

wherein the metal-composite-metal construction makes up at least a portion of the golf club head.

2. The golf club head of claim 1, wherein the golf club head comprises at least one of the following structures being composed of the metal-composite-metal construction: faceplate, face insert, internal ribs, turbulators, crown insert, or weight channel.

3. The golf club head of claim 2, further comprising the metal-composite-metal faceplate; wherein the metal-composite-metal faceplate comprises a mass that is 50% or less than a mass of an identical faceplate made of a metallic material.

4. The golf club head of claim 2, further comprising the metal-composite-metal internal ribs; wherein the metal-composite-metal internal ribs comprise a mass that is 25% or less than a mass of identical ribs made of a metallic material.

5. The golf club head of claim 2, further comprising the metal-composite-metal weight channel; wherein the metal-composite-metal weight channel comprises a mass that is 40% or less than a mass of an identical weight channel made of a metallic material.

6. The golf club head of claim 1, wherein the second layer further comprises a plurality of uni-direction fibers, multi-directional fibers, or a combination of uni- and multi-directional fibers.

7. The golf club head of claim 6, wherein the club head defines an x-axis perpendicular to the z-axis, and parallel to a ground plane; wherein the remaining reinforcing fibers of the fiber-reinforced composite material are generally oriented in the x-axis direction.

8. The golf club head of claim 1, wherein the offset distance is no more than 0.75 inch.

9. The golf club head of claim 1, wherein the first layer and the third layer abut one another within the perimeter region.

10. The golf club head of claim 1, wherein the offset region is devoid of the second layer.

11. The golf club head of claim 1, wherein the first layer and the third layer define a pocket which houses the second layer.

12. The golf club head of claim 1, wherein the fiber-reinforced composite material of the second layer is a laminate formed from multiple sheets of fiber-reinforced composite material; wherein the second layer comprises a forward sheet, a middle sheet, and a rearward sheet; wherein the forward sheet abuts the first layer, the rearward sheet abuts the third layer, and the middle sheet is disposed between the forward sheet and the rearward sheet.

13. The golf club head of claim 1, wherein the golf club head defines a loft plane, tangent to a geometric center of the face insert, and a z-axis perpendicular to the loft plane; wherein a portion of the reinforcing fibers of the fiber-reinforced composite material are oriented between 0 degrees and 45 degrees of the z-axis.

14. The golf club head of claim 1, wherein the metallic materials of the first and third layers are any one or combination of the following materials: titanium (Ti), titanium alloy (e.g. Ti-6-4, Ti-8-1-1, T-9S, or BE α-β Ti alloy), aluminum (Al), aluminum alloy, steel, steel alloy, tin, or tin alloy.

15. The golf club head of claim 1, wherein the first and third layer are composed of the same metallic material.

16. The golf club head of claim 1, wherein the first layer material has a first layer density, the second layer material has a second layer density, and the third layer material has a third layer density; and wherein the second layer density is less than the first layer density and the third layer density.

17. The golf club head of claim 1, wherein the fiber-reinforced composite material of the second layer comprises one of combination of materials selected from the group consisting of: polyethylenimine (PEI), polyether ether ketone (PEEK), polyaryletherketone (PAEK), thermoplastic polyurethane (TPU), polyphthalamide (PPA), Nylon 6 (6-6, 11, 12), and polyphenylene (PPS).

18. The golf club head of claim 1, wherein the fiber-reinforced composite material of the second layer comprises natural and synthetic fibers selected from the group consisting of: carbon fiber, glass fiber, Kevlar fiber, natural fiber, ultra-high molecular weight polyethylene (UHMWPE) fiber, and any suitable fiber.

19. The golf club head of claim 1, wherein the portion of the golf club head formed from the metal-composite-metal construction reduces a total mass of the golf club head by up to 20%.

20. A golf club head comprising:
- a body and a faceplate; and
- a metal-composite-metal construction, the metal-composite-metal construction comprising:
  - a first layer, a second layer, and a third layer;
    - wherein the first layer is composed of a metallic material;
    - wherein the second layer is composed of a fiber-reinforced composite material;
      - wherein the fiber-reinforced composite material of the second layer is a laminate formed from multiple sheets of fiber-reinforced composite material; wherein the second layer comprises a forward sheet, a middle sheet, and a rearward sheet; wherein the forward sheet abuts the first layer, the rearward sheet abuts the third layer, and the middle sheet is disposed between the forward sheet and the rearward sheet;
    - wherein the third layer is composed of a metallic material;
    - wherein the metal-composite-metal construction makes up at least a portion of the golf club head.

21. The golf club head of claim 20, wherein the golf club head comprises at least one of the following structures being composed of the metal-composite-metal construction: faceplate, face insert, internal ribs, turbulators, crown insert, or weight channel.

22. The golf club head of claim 21, further comprising the metal-composite-metal faceplate; wherein the metal-composite-metal faceplate comprises a mass that is 50% or less than a mass of an identical faceplate made of a metallic material.

23. The golf club head of claim 21, further comprising the metal-composite-metal internal ribs; wherein the metal-composite-metal internal ribs comprise a mass that is 25% or less than a mass of identical ribs made of a metallic material.

24. The golf club head of claim 21, further comprising the metal-composite-metal weight channel; wherein the metal-composite-metal weight channel comprises a mass that is 40% or less than a mass of an identical weight channel made of a metallic material.

25. The golf club head of claim 20, wherein the second layer further comprises a plurality of uni-direction fibers, multi-directional fibers, or a combination of uni- and multi-directional fibers.

26. The golf club head of claim 25, wherein the club head defines an x-axis perpendicular to the z-axis, and parallel to a ground plane; wherein the remaining reinforcing fibers of the fiber-reinforced composite material are generally oriented in the x-axis direction.

27. The golf club head of claim 20, wherein the first layer and the third layer abut one another within the perimeter region.

28. The golf club head of claim 20, wherein the first layer and the third layer define a pocket which houses the second layer.

29. The golf club head of claim 20, wherein the golf club head defines a loft plane, tangent to a geometric center of the face insert, and a z-axis perpendicular to the loft plane; wherein a portion of the reinforcing fibers of the fiber-reinforced composite material are oriented between 0 degrees and 45 degrees of the z-axis.

30. The golf club head of claim 20, wherein the metallic materials of the first and third layers are any one or combination of the following materials: titanium (Ti), titanium alloy (e.g. Ti-6-4, Ti-8-1-1, T-9S, or BE α-β Ti alloy), aluminum (Al), aluminum alloy, steel, steel alloy, tin, or tin alloy.

31. The golf club head of claim 20, wherein the first and third layer are composed of the same metallic material.

32. The golf club head of claim 20, wherein the first layer material has a first layer density, the second layer material has a second layer density, and the third layer material has a third layer density; and wherein the second layer density is less than the first layer density and the third layer density.

33. The golf club head of claim 20, wherein the fiber-reinforced composite material of the second layer comprises one of combination of materials selected from the group consisting of: polyethylenimine (PEI), polyether ether ketone (PEEK), polyaryletherketone (PAEK), thermoplastic polyurethane (TPU), polyphthalamide (PPA), Nylon 6 (6-6, 11, 12), and polyphenylene (PPS).

34. The golf club head of claim 20, wherein the fiber-reinforced composite material of the second layer comprises natural and synthetic fibers selected from the group consisting of: carbon fiber, glass fiber, Kevlar fiber, natural fiber, ultra-high molecular weight polyethylene (UHMWPE) fiber, and any suitable fiber.

35. The golf club head of claim 20, wherein the portion of the golf club head formed from the metal-composite-metal construction reduces a total mass of the golf club head by up to 20%.

36. A golf club head comprising:
- a body and a faceplate; and
- a metal-composite-metal construction, the metal-composite-metal construction comprising:
  - a first layer, a second layer, and a third layer;
    - wherein the first layer is composed of a metallic material;
    - wherein the second layer is composed of a fiber-reinforced composite material;
      - wherein the fiber-reinforced composite material of the second layer comprises one of combination of materials selected from the group consisting of: polyethylenimine (PEI), polyether ether ketone (PEEK), polyaryletherketone (PAEK), thermoplastic polyurethane (TPU), polyphthalamide (PPA), Nylon 6 (6-6, 11, 12), and polyphenylene (PPS);

wherein the third layer is composed of a metallic material;

wherein the metal-composite-metal construction makes up at least a portion of the golf club head.

37. The golf club head of claim 36, wherein the golf club head comprises at least one of the following structures being composed of the metal-composite-metal construction: faceplate, face insert, internal ribs, turbulators, crown insert, or weight channel.

38. The golf club head of claim 37, further comprising the metal-composite-metal faceplate; wherein the metal-composite-metal faceplate comprises a mass that is up to 50% less than a mass of an identical faceplate made of a metallic material.

39. The golf club head of claim 37, further comprising the metal-composite-metal internal ribs; wherein the metal-composite-metal internal ribs comprise a mass that is up to 25% less than a mass of identical ribs made of a metallic material.

40. The golf club head of claim 37, further comprising the metal-composite-metal weight channel; wherein the metal-composite-metal weight channel comprises a mass that is up to 40% less than a mass of an identical weight channel made of a metallic material.

* * * * *